US006485592B1

(12) United States Patent
Yoshimura et al.

(10) Patent No.: US 6,485,592 B1
(45) Date of Patent: Nov. 26, 2002

(54) PRECURSOR FIBER BUNDLE FOR MANUFACTURE OF CARBON FIBER, MANUFACTURING APPARATUS AND METHOD OF MANUFACTURING CARBON FIBER BUNDLE

(75) Inventors: Kousuke Yoshimura, Shiga (JP); Toshihide Sekido, Shiga (JP); Makoto Endo, Ehime (JP); Takao Sano, Shiga (JP)

(73) Assignee: Toray Industries, Inc. (JP)

( * ) Notice: Subject to any disclaimer, the term of this patent is extended or adjusted under 35 U.S.C. 154(b) by 0 days.

(21) Appl. No.: 09/171,077

(22) PCT Filed: Feb. 13, 1998

(86) PCT No.: PCT/JP98/00581

§ 371 (c)(1),
(2), (4) Date: Oct. 13, 1998

(87) PCT Pub. No.: WO98/36113

PCT Pub. Date: Aug. 20, 1998

(30) Foreign Application Priority Data

Feb. 14, 1997 (JP) ..... 9-047255

(51) Int. Cl.[7] ..... B65H 69/06; D01F 9/12

(52) U.S. Cl. ..... 156/148; 57/22; 57/23; 57/202; 57/350; 156/158; 156/502; 264/29.2; 423/447.4

(58) Field of Search ..... 156/157, 158, 156/148, 502; 57/22, 23, 350, 202; 264/29.2; 423/447.4

(56) References Cited

U.S. PATENT DOCUMENTS 3,108,028 A * 10/1963 Sprunck et al. ..... 156/440
3,339,362 A * 9/1967 Dodson et al. ..... 57/22
3,487,618 A * 1/1970 Arguelles ..... 57/22
3,581,486 A * 6/1971 Dibble ..... 57/22
3,945,962 A * 3/1976 Clark
3,996,325 A * 12/1976 Megraw ..... 156/62.2
4,048,277 A * 9/1977 Breznak et al. ..... 156/157
4,335,089 A * 6/1982 Maruyama et al. ..... 423/447.4
4,466,949 A * 8/1984 Mori ..... 264/29.2
4,501,037 A * 2/1985 Lay et al. ..... 156/157
4,555,899 A * 12/1985 Mima ..... 57/22
4,788,050 A * 11/1988 Hirose et al. ..... 264/29.2
4,803,762 A * 2/1989 Sheehan ..... 156/158
5,155,987 A * 10/1992 Vogel ..... 57/22

FOREIGN PATENT DOCUMENTS

JP 53-23411 * 7/1978
JP 54-50624 * 4/1979
JP 56-37315 * 4/1981
JP 58-208420 * 12/1983
JP 60-2407 B2 * 1/1985
JP 1-12850 B2 * 3/1989
JP 6-287832 * 10/1994

* cited by examiner

*Primary Examiner*—Steven D. Maki
(74) *Attorney, Agent, or Firm*—Schnader Harrison Segal & Lewis LLP

(57) ABSTRACT

A continuous precursor fiber bundle for manufacture of carbon fibers comprising a plurality of precursor fiber bundles each of which comprises at least 30,000 filaments, having a joined portion formed by joining at the terminal end of one of the precursor fiber bundles and the starting end of another one of the fiber bundles directly or through an intervening fiber bundle comprising a plurality of filaments, wherein the individual filaments at the joined portion are substantially uniformly interlaced with each other and wherein the interlacing of filaments is in a pattern selected from the group consisting of continuous substantially uniform interlacing in the transverse direction of said fiber bundles, interlacing at many joints on the joining portion, and interlacing of the entire face of said joining portion.

24 Claims, 7 Drawing Sheets

PRECURSOR FIBER BUNDLE FOR MANUFACTURE OF CARBON FIBER, MANUFACTURING APPARATUS AND METHOD OF MANUFACTURING CARBON FIBER BUNDLE

TECHNICAL FIELD

The present invention relates to a precursor fiber bundle for manufacture of carbon fibers, a production apparatus thereof, and a method for manufacturing a carbon fiber bundle. Particularly, the present invention relates to a series of precursor fiber bundles for manufacture of carbon fibers, composed of at least two fiber bundles each of which comprises 30,000 or more filaments and which fiber bundles are joined each other at the terminal end of one and the starting end of the other one directly or through an intervening fiber bundle, a production apparatus thereof, and a method for manufacturing a carbon fiber bundle using the series of precursor fiber bundles for manufacture of carbon fibers. The series of precursor fiber bundles for manufacture of carbon fibers is stabilized to make a stabilized fiber bundle which is further carbonized to make a carbon fiber bundle.

BACKGROUND ART

Carbon fibers have been used as reinforcing materials of aircraft and sporting goods. Recently, carbon fibers begin to be used also as architectural and civil engineering materials and reinforcing materials for members of energy related apparatuses, and such demands are growing rapidly. To meet these demands and furthermore to further increase the demands, carbon fibers having at least conventional properties and less expensive than the conventional carbon fibers are being demanded.

To supply less expensive carbon fibers to the market, the production cost of carbon fibers must be lowered. One method for reducing the cost is to heat-treat (stabilizing and carbonizing) a precursor fiber bundle for manufacture of carbon fibers which fiber bundle has far more filaments than before, for improving the productivity of carbon fibers.

However, if the number of filaments in a precursor fiber bundle increases, i.e., if the filament density becomes higher, heat accumulation in the precursor fiber bundle during stabiizing treatment performing in an oxidizing atmosphere (air) tends to be large. As a result, the filaments are likely to generate heat, and the oxidation reaction of filaments in the stabilizing treatment tends to run away.

So, where the filament density is higher, the stabilizing temperature in the stabilizing treatment must be set at a level lower than that in the stabilizing treatment of a precursor bundle having lower filament density, to take a longer time for the stabilizing treatment, in order to prevent the filament breaking due to the runaway reaction.

However, if the stabilizing treatment temperature is lowered greatly, the stabilizing treatment time becomes too long, and it can happen that the productivity of stabilizing treatment is not improved even though the filament density is higher.

On the other hand, the stabilizing treatment process comprises the steps of continuously supplying a series of precursor fiber bundles from the inlet of a stabilizing treatment furnace into the furnace, stabilizing it in the furnace, to produce a stabilized fiber bundle, and continuously taking out the stabilized fiber bundle from the outlet of the furnace.

The precursor fiber bundle continuously supplied into the stabilizing treatment process must be a series of precursor fiber bundles formed by joining a plurality of precursor fiber bundles at the terminal end of one and the starting end of another, each of which bundles is wound around bobbins or spools or contained in cans with a certain limited length.

However, where precursor fiber bundles having a high filament density are simply joined each other, the filament density at the joined portion becomes very higher than the filament density at the other portions (main bundle portions). Simply, the filament density becomes double. Therefore, in the stabilizing treatment, the oxidation reaction of filaments at the joined portion tends to run away compared to the main bundle portion.

A method for splicing or joining precursor bundles is described in Japanese Patent Publication (Kokoku) No. 53-23411. In this method, precursor fiber bundles are spliced each other at the mating ends into a series of precursor fiber bundles, and the series of precursor fiber bundles are treated to be stabilized. Then, the joining portion of the series of stabilized fiber bundles is cut off and removed, and each of the bundles are re-spliced into a series of stabilized fiber bundles and treated to be carbonized.

Japanese Patent Laid-Open (Kokai) No. 54-50624 describes a method of applying a flame resistant compound such as silicone grease to the joining portions.

Furthermore, Japanese Patent Laid-Open (Kokai) No. 56-37315 describes a method comprising heat-treating the ends (the starting end and the terminal end) of precursor fiber bundles and then the precursor fiber bundles are spliced each other by a specific splicing method.

Moreover, Japanese Patent Laid-Open (Kokai) No. 58-208420 describes a method for interlacing the terminal end of one precursor fiber bundle and the starting end of another precursor fiber bundle by a high speed fluid.

However, in any of these methods, since the filament density at the joining portion becomes very higher than that of the main bundle portion, burning, breaking, etc. of filaments are likely to be caused by the heat accumulation during stabilization treatment.

Japanese Patent Publication (Kokoku) No. 60-2407 describes intervening stabilized fibers or carbon fibers at the splicing portion for inhibiting the heat accumulation. However, since the square knot is used for the joining portion, the knot is tightened and the filament density becomes higher. So, the heat accumulation inhibiting effect is small.

As a method for improving these disadvantages, Japanese Patent Publication (Kokoku) No. 1-12850 describes interlacing precursor fiber bundles with each other or interlacing a precursor fiber bundle with a stabilized fiber bundle.

FIG. 1 is a perspective view showing an example of the method. In this method, the mating ends 2*a* and 2*b* of the fiber bundles to be joined are simply overlaid in the form of the bundles as they are, inserted into an interlacing treatment chamber 4 of a fluid interlacing nozzle 1, relaxed by about 5 to 60%, and treated by a high speed fluid jetted from two nozzle holes 3 for interlacing the filaments at both ends 2*a* and 2*b* with each other. The method for joining with an intervening of a stabilized fiber bundle has an effect that the heat accumulation at the joining portion makes small compared to the direct joining of precursor fiber bundles since the stabilized fibers little generate heat in the stabilizing process.

As for the fluid interlacing nozzle used in this conventional method, as shown in FIG. 1, the high speed jets injected from the two nozzle holes 3 installed in the small entangling treatment chamber 4 collide with each other in the interlacing treatment chamber 4, to produce turbulent flow which opens the fiber bundles for interlacing the filaments with each other. This method is effective for fiber bundles small in the number of filaments constituting them.

However, if the number of filaments constituting each of the fiber bundles to be joined is very large, the jets injected from the nozzle holes do not hit all the filaments of the fiber bundles, and the fiber bundles are not interlaced at filament level and it remarkably happens interlacing between sub-bundles of filaments each other. Such interlaced sub-bundles of filaments occur unevenly at the joining portion and portions with high filament densities are locally formed, and heat is likely to be accumulated there.

An interlacing based on several interlaced sub-bundles of filaments is weak in joining strength since interlacing strength between filaments is weak. The examples described in Japanese Patent Publication (Kokoku) No. 1-12850 disclose only fiber bundle comprising up to 12,000 filaments. If precursor fiber bundles each of which comprises 30,000 or more filaments handling in the present invention are joined at their mating ends directly or through an intervening stabilized fiber bundle according to the known method, breakage of filaments and burning out of filaments due the accumulation of heat occur for the reasons described above.

In addition, in the case of precursor fiber bundles having a high filament density, as the case may be, it may be necessary to impart crimps to the fiber bundles for intensifying the integrity between filaments for better handling convenience in continuously taking out the bundles from their stored condition. Since the crimped fiber bundles are bulky and have their filaments slightly entangled with each other, it is difficult to join the mating ends of the crimped precursor fiber bundles by using the method described in Japanese Patent Publication (Kokoku) No. 1-12850.

That is, even if crimped fiber bundles are overlaid and treated by a high speed fluid, the fiber bundles cannot be sufficiently opened compared to noncrimped fiber bundles since they are crimped. Furthermore, being crimped, the fiber bundles are bulky, cottony and likely to be inhibited in the movement of filaments, and interlacing at filament level is not sufficient compared to non-crimped fiber bundles. Therefore, compared to non-crimped fiber bundles, the filaments are less uniformly entangled with each other at the joining portion, and the joining strength at the joined portion becomes low.

DISCLOSURE OF THE INVENTION

In view of the above problems, the object of the present invention is to provide a continuous precursor fiber bundle for manufacture of carbon fibers, comprising two thick fiber bundles respectively having 30,000 or more filaments and joined each other at their mating ends directly or through an intervening fiber bundle, with the filaments of both the fiber bundles interlaced with each other at the joined portion, and also to provide a production apparatus thereof.

Another object of the present invention is to provide a method for manufacturing a carbon fiber bundle comprising stabilizing the continuous precursor fiber bundle and further carbonizing.

The precursor fiber bundle for manufacture of carbon fibers, the production apparatus thereof, and the method for manufacturing a carbon fiber bundle using the precursor fiber bundle, respectively of the present invention to achieve the above objects are as follows.

The following inventions A1 through A6 are included in the precursor fiber bundle for manufacture of carbon fibers of the present invention respectively.

Invention A1

A precursor fiber bundle for manufacture of carbon fibers, comprising a first precursor fiber bundle for manufacture of carbon fibers, having 30,000 or more filaments, a second precursor fiber bundle for manufacture of carbon fibers, having 30,000 or more filaments, and an intervening fiber bundle comprising many filaments having non-exothermic property at stabilizing treatment temperature, wherein the terminal end of said first fiber bundle and the starting end of said second fiber bundle are joined through said intervening fiber bundle; and at a first joined portion where the terminal end of said first fiber bundle and the starting end of said intervening fiber bundle are joined and at a second joined portion where the starting end of said second fiber bundle and the terminal end of said intervening fiber bundle respectively, the filaments in the respective fiber bundles are substantially uniformly interlaced with each other.

Invention A2

A precursor fiber bundle for manufacture of carbon fibers according to A1, wherein the intervening fiber bundle comprises a stabilized fiber bundle.

Invention A3

A precursor fiber bundle for manufacture of carbon fibers according to A2, wherein a relation of $0.4 \times G \leqq F \leqq 1.5 \times G$ is satisfied where F is the number of filaments of the stabilized fiber bundle and G is the number of filaments of each of the precursor fiber bundles for manufacture of carbon fibers.

Invention A4

A precursor fiber bundle for manufacture of carbon fibers according to any one of A1 through A3, wherein the filaments of each of the precursor fiber bundles for manufacture of carbon fibers have crimps and the crimps are removed at the joined portions.

Invention A5

A precursor fiber bundle for manufacture of carbon fibers, comprising a first precursor fiber bundle for manufacture of carbon fibers, having 30,000 or more filaments and a second precursor fiber bundle for manufacture of carbon fibers, having 30,000 or more filaments, wherein the terminal end of said first fiber bundle and the starting end of said second fiber bundle are directly joined, and the filaments in the respective fiber bundles are substantially uniformly interlaced with each other at a joined portion where the terminal end of said first fiber bundle and the starting end of said second fiber bundle are joined.

Invention A6

A precursor fiber bundle for manufacture of carbon fibers according to A5, wherein said filaments of each of the precursor fiber bundles for manufacture of carbon fibers have crimps, and the crimps are removed at the joined portion.

The following inventions B1 through B6 are included in the apparatus for producing the precursor fiber bundle for manufacture of carbon fibers of the present invention respectively.

Invention B1

An apparatus for producing a precursor fiber bundle for manufacture of carbon fibers, comprising (a) a first fiber bundle holding means for holding the flatly opened terminal end of a first precursor fiber bundle for manufacture of carbon fibers, having 30,000 or more filaments, in the transverse direction of the terminal end, at least at two positions apart from each other in the longitudinal direction, (b) a second fiber bundle holding means for holding the flatly opened starting end of a second precursor fiber bundle for manufacture of carbon fibers, having 30,000 or more filaments, in the transverse direction of the starting end, at least at two positions apart from each other in the longitudinal direction, (c) an intervening fiber bundle holding means for holding the flatly opened starting and terminal ends of an intervening fiber bundle comprising many filaments having non-exothermic property at stabilizing treatment temperature, in the transverse direction of the starting and terminal ends, at least at two positions apart from each other in the longitudinal direction, (d) a first interlacing treatment means for interlacing the filaments each other at the terminal end of said first fiber bundle and the starting end of said intervening fiber bundle, and (e) a second interlacing treatment means for interlacing the filaments each other at the starting end of said second fiber bundle and the terminal end of said intervening fiber bundle, wherein (f) said first fiber bundle holding means and said second fiber bundle holding means are provided in such a manner that the tip of the terminal end of said first fiber bundle and the tip of the starting end of said second fiber bundle are subjected to face each other, and (g) said intervening fiber bundle holding means is provided in such a manner that the intervening fiber bundle is subjected to overlap with said first fiber bundle held by said first fiber bundle holding means and said second fiber bundle held by said second fiber bundle holding means.

Invention B2

An apparatus for producing a precursor fiber bundle for manufacture of carbon fibers according to B1, wherein the first interlacing treatment means and the second interlacing treatment means are filament interlacing treatment means using fluid respectively.

Invention B3

An apparatus for producing a precursor fiber bundle for manufacture of carbon fibers according to B1, wherein the first interlacing treatment means and the second interlacing treatment means are filament interlacing treatment means using a needle punch respectively.

Invention B4

An apparatus for producing a precursor carbon fiber bundle for manufacture of carbon fibers, comprising (a) a first fiber bundle holding means for holding the flatly opened terminal end of a first precursor fiber bundle for manufacture of carbon fibers, having 30,000 or more filaments, in the transverse direction of the terminal end, at least at two positions apart from each other in the longitudinal direction, (b) a second fiber bundle holding means for holding the flatly opened starting end of a second precursor fiber bundle for manufacture of carbon fibers, having 30,000 or more filaments, in the transverse direction of the starting end, at least at two positions apart from each other in the longitudinal direction, and (c) an interlacing treatment means for interlacing the filaments each other at the terminal end of said first fiber bundle and the starting end of said second fiber bundle, wherein (d) said first fiber bundle holding means and said second fiber bundle holding means are provided in such a manner that said first fiber bundle held by said first fiber bundle holding means and said second fiber bundle held by said second fiber bundle holding means are subjected to overlap with each other.

Invention B5

An apparatus for producing a precursor fiber bundle for manufacture of carbon fibers according to B4, wherein the interlacing treatment means is filament interlacing treatment means using fluid.

Invention B6

An apparatus for producing a precursor fiber bundle for manufacture of carbon fibers according to B4, wherein the interlacing treatment means is filament interlacing treatment means using a needle punch.

The following inventions C1 through C16 are included in the method for manufacturing the carbon fiber bundle of the present invention.

Invention C1

A method for manufacturing a carbon fiber bundle, comprising (a) a step of overlaying the flatly opened terminal end of a first precursor fiber bundle for manufacture of carbon fibers, having 30,000 or more filaments and the flatly opened starting end of an intervening fiber bundle comprising many filaments having non-exothermic property, and substantially uniformly interlacing the filaments of both of the fiber bundles with each other to form a first joining portion, (b) a step of overlaying the flatly opened starting end of a second precursor fiber bundle for manufacture of-carbon fibers, having 30,000 or more filaments and the flatly opened terminal end of said intervening fiber bundle, and substantially uniformly interlacing the filaments of both of the fiber bundles with each other to form a second joining portion, (c) a step of treating to stabilize a continuous precursor fiber bundle for manufacture of carbon fibers formed with said first and second fiber bundles which are joined through said intervening fiber bundle at said first and second joining portions, to obtain a stabilized fiber bundle, and (d) a step of treating to carbonize said stabilized fiber bundle, to obtain a carbon fiber bundle.

Invention C2

A method for manufacturing a carbon fiber bundle according to C1, wherein the intervening fiber bundle comprises a stabilized fiber bundle.

Invention C3

A method for manufacturing a carbon fiber bundle according to C2, wherein a relation of $0.4\times G \leqq F \leqq 1.5\times G$ is satisfied where F is the number of filaments of the stabilized fiber bundle of the intervening fiber bundle and G is the number of filaments of each of the precursor fiber bundles for manufacture of carbon fibers.

Invention C4

A method for manufacturing a carbon fiber bundle according to any one of C1 through C3, wherein means for forming the first and second joining portions comprise filament interlacing means using fluid respectively.

Invention C5

A method for manufacturing a carbon fiber bundle according to C4, wherein when the first and second joining portions are formed, a density of each of the fiber bundles overlapping to form the first and second joining portions is 4,000 filaments/mm or less.

Invention C6

A method for manufacturing a carbon fiber bundle according to C5, wherein where filaments in the first and second fiber bundles have crimps, the crimps of the filaments at the terminal end of the first fiber bundle and the starting end of the second fiber bundle are removed before forming the first and second joining portions.

Invention C7

A method for manufacturing a carbon fiber bundle according to any one of C1 through C3, wherein means for forming the first and second joining portions comprise filament interlacing means using a needle punch respectively.

Invention C8

A method for manufacturing a carbon fiber bundle according to C7, wherein when the first and second joining portions are formed, a density of each of the fiber bundles overlapping to form the first and second joining portions is 4,000 filaments/mm or less.

Invention C9

A method for manufacturing a carbon fiber bundle according to C8, wherein where filaments in the first and second fiber bundles have crimps, the crimps of the filaments at the terminal end of the first fiber bundle and the starting end of the second fiber bundle are removed before forming the first and second joining portions.

Invention C10

A method for manufacturing a carbon fiber bundle, comprising (a) a step of overlaying the flatly opened terminal end of a first precursor fiber bundle for manufacture of carbon fibers, having 30,000 or more filaments and the flatly opened starting end of a second precursor fiber bundle for manufacture of carbon fibers, having 30,000 or more filaments, and substantially uniformly interlacing the filaments of both of the fiber bundles with each other to form a joining portion, (b) a step of treating to stabilize a continuous precursor fiber bundle for manufacture of carbon fibers formed with said first and second fiber bundles which are joined at the joining portion, to obtain a stabilized fiber bundle, and (c) a step of treating to carbonize said stabilized fiber bundle, to obtain a carbon fiber bundle. Invention C11

A method for manufacturing a carbon fiber bundle according to C10, wherein means for forming the joining portion comprises filament interlacing means using fluid.

Invention C12

A method for manufacturing a carbon fiber bundle according to C10, wherein means for forming the joining portion comprises filament interlacing means using a needle punch.

Invention C13

A method for manufacturing a carbon fiber bundle according to C11 or C12, wherein when the joining portion is formed, a density of each of the fiber bundles overlapping to form the joining portion is 4,000 filaments/mm or less.

Invention C14

A method for manufacturing a carbon fiber bundle according C13, wherein where filaments in the first and second fiber bundles have crimps, the crimps of the filaments at the terminal end of the first fiber bundle and the starting end of the second fiber bundle are removed before forming the joining portion.

Invention C15

A method for manufacturing a carbon fiber bundle according to C13 or C14, wherein after forming the joining portion and before the stabilizing treatment, a stabilization inhibitor is applied to the joining portion.

Invention C16

A method for manufacturing a carbon fiber bundle according to C15, wherein the stabilization inhibitor is boric acid water.

In the present invention, as the filaments constituting the precursor fiber bundles for manufacture of carbon fibers, filaments of an acrylic polymer conventionally used for production of carbon fibers is preferably used.

In the present invention, the filaments constituting the precursor fiber bundles for manufacture of carbon fibers may have crimps or have no crimp. If the filaments have crimps, it is preferable that a crimping degree of each of the filaments is 8 curls/25 mm to 13 curls/25 mm. When a precursor fiber bundle for manufacture of carbon fibers is joined with an intervening fiber bundle or another precursor fiber bundle for manufacture of carbon fibers, it is preferable that the crimps of the filaments are removed at a joining portion of the fiber bundles. It is preferable that a removal of the crimps is achieved by heat-treating the end of the fiber bundle.

In the present invention, the expression that the filaments of the intervening fiber bundle have non-exothermic property at stabilizing treatment temperature means that the calorific value obtained according to the DSC (differential scanning calorimeter) method at the stabilizing treatment temperature is 500 cal/g or less, and the detail will be described later.

As the intervening fiber bundle comprising many filaments having non-exothermic property at the stabilizing treatment temperature, a stabilized fiber bundle subjected to a stabilizing treatment, particularly a stabilized fiber bundle obtained by stabilizing a fiber bundle formed by acrylic polymer filaments at a temperature of 200° C. to 350° C. in air is preferably used.

In the present invention, the expression that the filaments are substantially uniformly interlaced with each other means that the many filaments constituting one fiber bundle and many filaments constituting another fiber bundle are individually interlaced with each other at single filament level, and does not mean interlacing between one group having several filaments and another group having several filaments.

In the present invention, a filament interlacing treatment means using fluid or a needle punch is preferably used as the filament interlacing treatment means for substantially uniformly interlacing filaments with each other at the joining portion formed between the end (the terminal end or the starting end) of a precursor fiber bundle and the end (the starting end or the terminal end) of an intervening fiber bundle, or at the joining portion formed between the end (the terminal end) of a precursor fiber bundle and the end (the starting end) of another precursor fiber.

It is preferable that the stabilizing treatment temperature for the precursor. fiber bundles for manufacture of carbon fibers in the present invention is 200° C. to 350° C.

Giving a stabilization inhibitor before stabilizing treatment, to the joining portion in one continuous precursor fiber bundle for manufacture of carbon fibers obtained by directly joining the mating ends of the precursor fiber bundles for manufacture of carbon fibers is intended to prevent burning and breaking of filaments likely to be caused by the heat accumulation at the joining portion during stabilizing treatment. As the stabilization inhibitor, boric acid water is preferably used.

THE BEST EMBODIMENTS OF THE INVENTION

The present invention is described below further in reference to the drawings based on examples.

An acrylic polymer is extruded from a spinneret to form many filaments, and they are taken up to produce a precursor fiber bundle for manufacture of carbon fibers. The precursor fiber bundle is treated to be stabilized for producing a stabilized fiber bundle. Furthermore, the stabilized fiber bundle is treated to be carbonized for producing a carbon fiber bundle.

Since the running speed of the fiber bundle in the production of a precursor fiber bundle is greatly different from the running speed of the fiber bundle in the stabilizing treatment process, the produced precursor fiber bundle is once wound around bobbins or folded to be contained in cans.

For stabilizing treatment of the precursor fiber bundle, the precursor fiber bundle is taken out of the stored condition and supplied to the stabilizing treatment process. The following description refers to a case where the precursor fiber bundles are contained in cans.

The precursor fiber bundle for manufacture of carbon fibers contained in a can is taken out of the can and treated to be stabilized in a stabilizing treatment furnace. The stabilizing treatment furnace is a conventionally known furnace. In the stabilizing treatment, the precursor fiber bundle is heat-treated in an oxidizing atmosphere (usually air) at 200° C. to 350° C., to be a stabilized fiber bundle.

The stabilized fiber bundle is then treated to be carbonized in a carbonizing treatment furnace. The carbonizing treatment furnace is a conventionally known furnace. In the carbonizing treatment, the stabilized fiber bundle is heat-treated in. an inactive atmosphere (usually nitrogen) at 500 to 1,500° C., to be a carbon fiber bundle.

The carbon fiber bundle is then usually surface-treated by a sizing agent, etc. and taken up as a carbon fiber product.

In the stabilizing treatment process, if the precursor fiber bundle taken out of a can and fed through the stabilizing furnace comes to its terminal end, the terminal end is joined with the starting end of the precursor fiber bundle contained in the next can. That is, the mating ends of the precursor fiber bundles are joined. The joined precursor fiber bundle is continuously supplied into the stabilizing furnace. In this way, the precursor fiber bundles contained in a plurality of cans are continuously supplied into the stabilizing furnace without interruption, and the stabilizing furnace is continuously operated.

The method for joining the respective mating ends of the precursor fiber bundles through an intervening fiber bundle respectively is described below.

Figure 2:
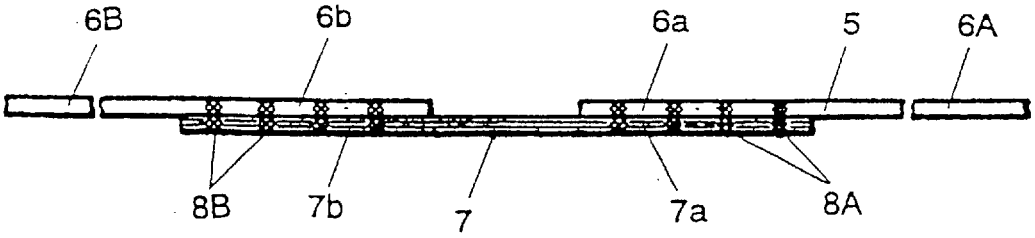
FIG. 2 is a typical side view showing the joining portions of an example of precursor fiber bundles for manufacture of carbon fibers in the present invention.

FIG. 2 is a typical side view showing one continuous precursor fiber bundle for manufacture of carbon fibers in the present invention. The one continuous precursor fiber bundle 5 for manufacture of carbon fibers has a first joining portion 8A where the terminal end 6a of the first precursor fiber bundle 6A consisting of 30,000 or more filaments and the starting end 7*a* of an intervening fiber bundle 7 consisting of many filaments having non-exothermic property at a stabilizing treatment temperature are joined each other, and also has a second joining portion 8B where the terminal end 7*b* of the intervening fiber bundle 7 and the starting end 6*b* of a second precursor fiber bundle 6B consisting of 30,000 or more filaments are joined each other. At the joining portions 8A and 8B, the filaments constituting the respective fiber bundles are substantially uniformly interlaced with each other.

Here, the expression that the filaments of the intervening fiber bundle have non-exothermic property at stabilizing treatment temperature means that the calorific value obtained according to the DSC (differential scanning calorimeter) method at the stabilizing treatment temperature is 500 cal/g or less. Method of measuring the calorific value is as follows.

The measuring instrument used is a differential scanning calorimeter (DSC). The sample is prepared by grinding 2 mg of an intervening fiber bundle (stabilized fibers) to lengths of about 3 mm, and inserting the ground fibers into an aluminum pan. For measurement, they are heated in air at a heating rate of 10° C./min from room temperature to 400° C. The calorific value is obtained as follows.

Figure 3:
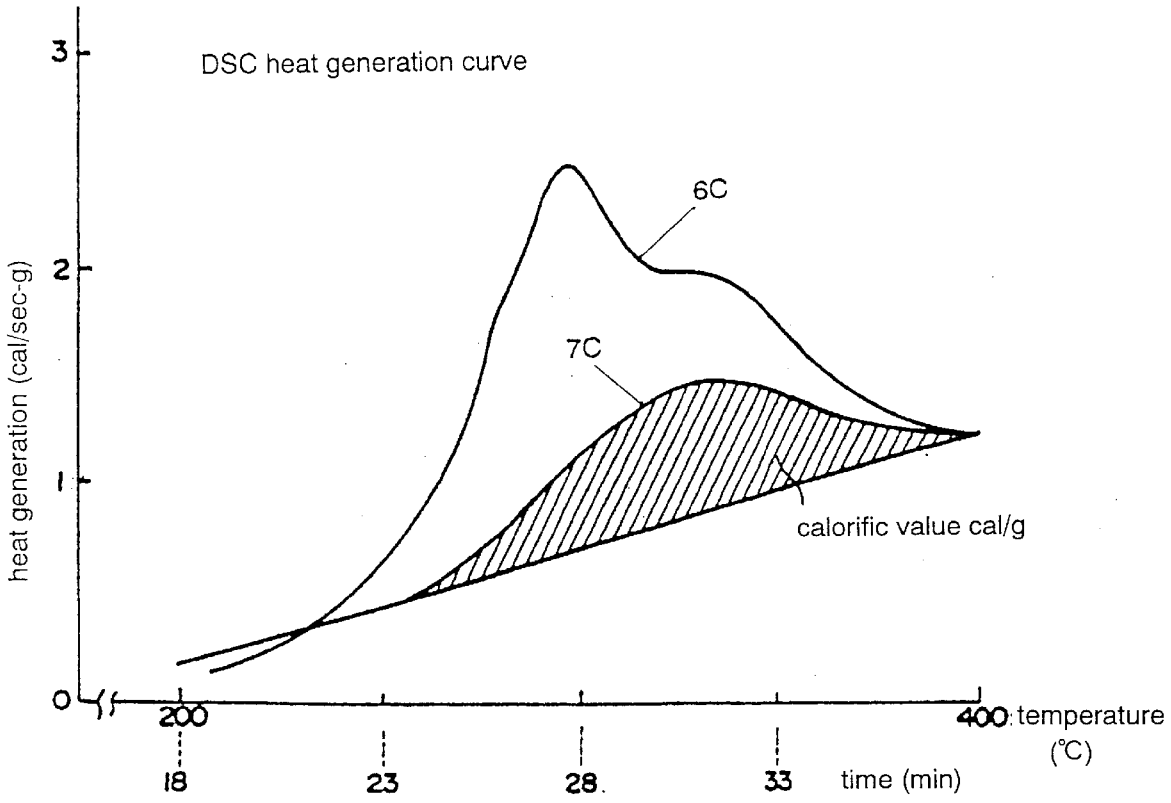
FIG. 3 is a graph for illustrating how to obtain the calorific value of an intervening fiber bundle.

FIG. 3 is a graph showing a DSC curve with the temperature (time) chosen as the abscissa and the calorific value chosen as the ordinate. As shown in FIG. 3, a straight line is drawn between the 200° C. point and the 400° C. point in the obtained heat generation curve, and the area demarcated by the straight line and the heat generation curve is identified as the calorific value (cal/g). FIG. 3 shows both the DSC curve 6C of precursor fibers and the DSC curve 7C of stabilized fibers.

The intervening fiber bundle (stabilized fiber bundle) 7 is joined with the precursor fiber bundles 6A and 6B as described below. Only the ends 6*a*, 6*b*, 7*a* and 7*b* of the precursor fiber bundles 6A and 6B and the stabilized fiber bundle 7 are respectively opened flatly, and the respective flatly opened ends 6*a* and 6*b* of the precursor fiber bundles 6A and 6B are overlaid with both the ends 7*a* and 7*b* of the stabilized fiber bundle 7, and in this state, the respective filaments are interlaced with each other by filament interlacing treatment using fluid, for joining.

By opening flatly the ends 6*a*, 6*b*, 7*a* and 7*b* of the fiber bundles 6A, 6B and 7 and then overlaying them, interlacing between the filaments is performed at level of filament in sufficient.

In this case, if the fiber bundle is not opened in flat, bundles each of which consisting of several filaments are interlaced with each other in a state of bundle and thus obtained interlacing has non-uniformity. It is preferable that the flatly opening shows a density of 4,000 flaments/mm or less.

The end of fiber bundle can be opened by any method conventionally used for opening fiber bundles. Any known apparatuses and tools for opening can be used, but usually the desired opening can be effected by manual work. For example, for opening, the ends of the fiber bundles are placed on flat holding elements of the fiber bundle holding means described later, and if the fiber bundles are distorted, they can be dispersed smoothly and evenly manually in the transverse direction, to achieve a desired filament density (number of filaments per unit width).

If a stabilized fiber bundle is used as the intervening fiber bundle, it is desirable to select the number of filaments of the stabilized fiber bundle in a proper range, considering the properties, number of filaments, form, breaking strength, etc. of the precursor fiber bundle to be joined with.

When the number of filaments F of the stabilized fiber bundle becomes smaller compared to the number of filaments G of each of the precursor fiber bundles, the interlacing force achieved by the interlacing of filaments at the joining portions 8A and 8B declines. Still in this case, the precursor fiber bundles 6A and 6B are joined with the stabilized fiber bundle 7. However, if the joined fiber bundle is treated to be stabilized, it may happen that the joining portions 8A and 8B cannot endure the tension caused in the fiber bundle in the stabilizing treatment furnace. This lowers the fiber bundle passing rate in the stabilizing treatment process.

On the contrary, when the number of filaments F of the stabilized fiber bundle becomes larger compared to the number of filaments G of each of the precursor fiber bundle, the precursor fiber bundles at the joining portions are covered with the stabilized fiber bundle, and it may become hard to remove the stabilizing reaction heat of the precursor fiber bundles. As a result, the effect of inhibiting the heat accumulation at the joining portions declines.

So, it is preferable that the number of filaments F of the stabilized fiber bundle used as the intervening fiber bundle and the number of filaments G of each of the precursor fiber bundles satisfy a relation of $0.4 \times G \leqq F \leqq 1.5 \times G$.

Figure 4:
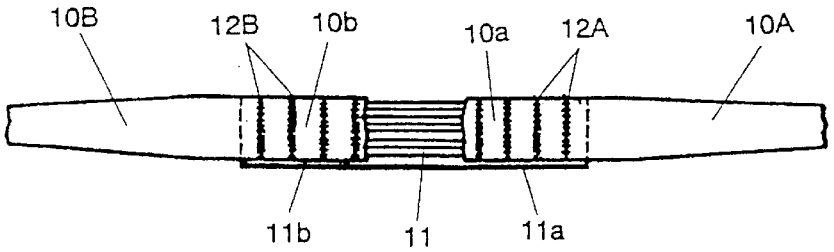
FIG. 4 is a typical plan view showing the joining portions of another example of precursor fiber bundles for manufacture of carbon fibers in the present invention.
Figure 5:
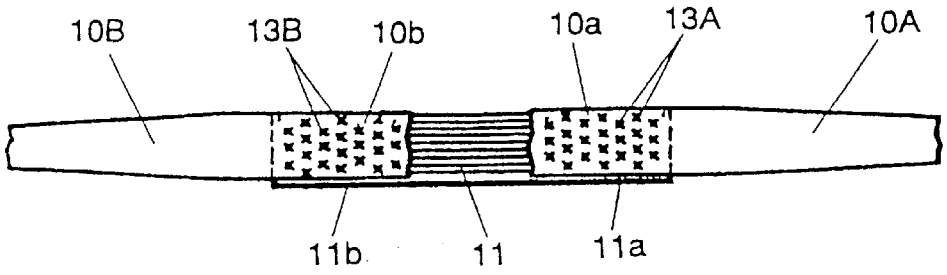
FIG. 5 is a typical plan view showing the joining portions of another example of precursor fiber bundles for manufacture of carbon fibers in the present invention.
Figure 6:
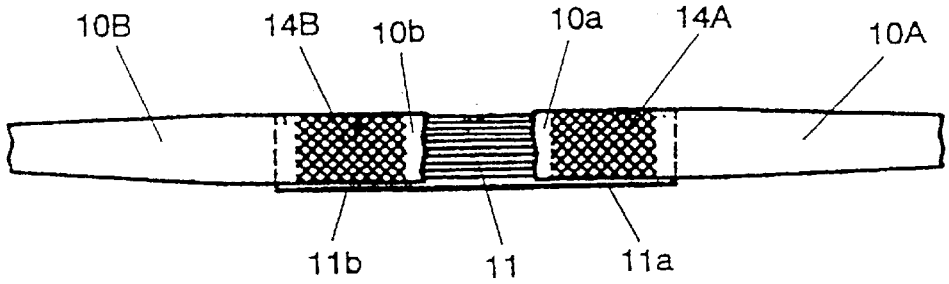
FIG. 6 is a typical plan view showing the joining portions of still another example of precursor fiber bundles for manufacture of carbon fibers in the present invention.

FIGS. 4 to 6 are plan views showing the respectively different joining styles between the precursor fiber bundles and the intervening fiber bundle.

In the example shown in FIG. 4, the joining portions 12A and 12B of the ends 10*a* and 10*b* of the flatly opened precursor fiber bundles 10A and 10B with both the ends 11*a* and 11*b* of the intervening fiber bundle 11 are formed as described below. At the joining portions 12A and 12B, the filament interlacing treatment using fluid causes the filaments to be interlaced with each other continuously in the transverse direction at certain intervals in the longitudinal direction of the fiber bundle.

In the example shown in FIG. 5, at the joining portions 13A and 13B, the filaments are interlaced at many points.

In the example shown in FIG. 6, at the joining portions 14A and 14B, the filaments are interlaced almost in the entire faces of the joining portions.

In the examples of FIGS. 4 to 6, the intervening fiber bundle 11 is arranged only on one side of the precursor fiber bundles 10A and 10B, but two intervening fiber bundles may also be used to arrest the precursor fiber bundles 10A and 10B from both sides.

It is preferable that the fluid used for interlacing the filaments with each other as shown in FIGS. 4 to 6 is jetted at a high speed to the filaments. The fluids which can be used here include steam, water, air, etc., but in view of working convenience and economy, air is preferable.

Figure 7:
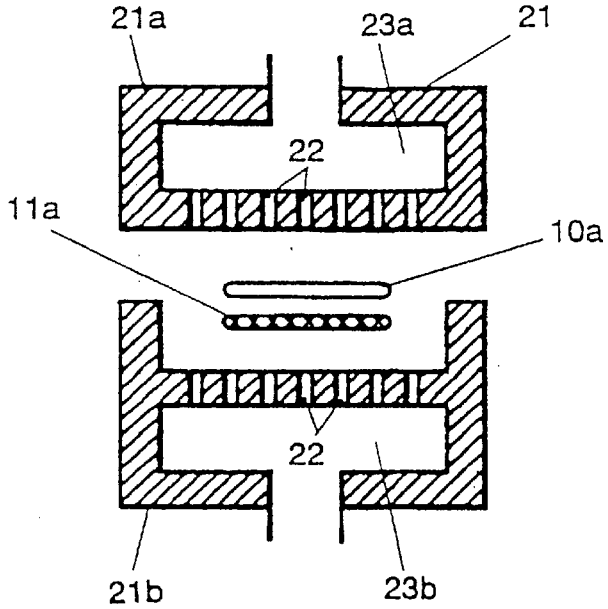
FIG. 7 is a schematic cross sectional view showing an example of air interlacing nozzle device preferably used for forming a joining portion of precursor fiber bundles for manufacture of carbon fibers in the present invention, as an example.

As a device for filament interlacing treatment using air, for example, the air interlacing nozzle device as shown in FIG. 7 can be preferably used.

Figure 8:
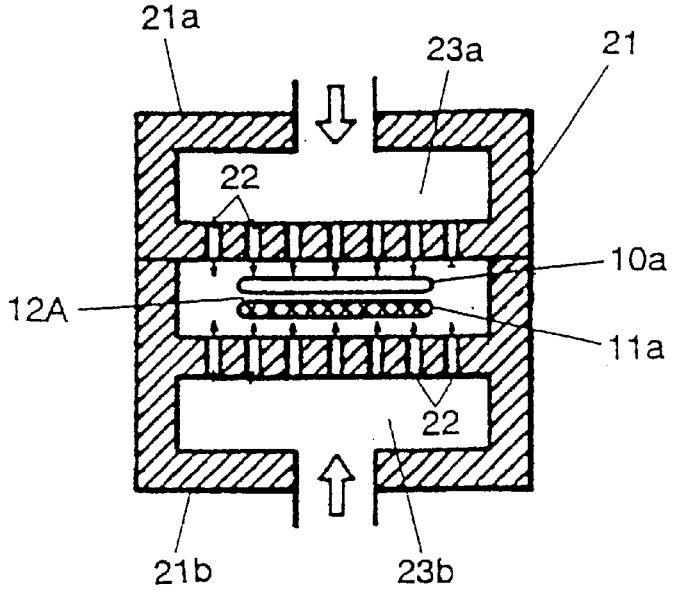
FIG. 8 is a schematic cross sectional view for illustrating the operation to form a joining portion of precursor fiber bundles for manufacture of carbon fibers by using the nozzle device shown in FIG. 7.

FIG. 7 is a schematic cross sectional view showing an air interlacing nozzle device as an example. FIG. 8 is a schematic cross sectional view for illustrating the filament interlacing treatment by using the air interlacing nozzle device shown in FIG. 7.

In FIGS. 7 and 8, the air interlacing nozzle device 21 is divided into a nozzle top 21*a* and a nozzle bottom 21*b* for placing the terminal end 10*a* (starting end 10*b*) of the fiber bundle 10A (10B) and the starting end 11*a* (terminal end 11*b*) of the intervening fiber bundle in the fluid treatment chamber. In the air interlacing nozzle device 21, the flatly opened end 10*a* (10*b*) of the precursor fiber bundle 10A (10B) and the flatly opened end 11*a* (11*b*) of the intervening fiber bundle 11 are overlaid each other. Then, as shown in FIG. 8, the nozzle top 21*a* and the nozzle bottom 21*b* are coupled, and the pressure air equalized in equalizing chambers 23*a* and 23*b* is jetted from many nozzle holes 22 formed in the nozzle top and bottom to the position where the joining portion 12A (12B) is to be formed. The jetted air opens the fiber bundles into substantially individual filaments, and makes the filaments entangled with each other, to form the joining portion 12A (12B).

The appropriate pressure of the air supplied to the air interlacing nozzle device depends on the filament fineness, number of filaments, existence of crimps, deposition of oil on filaments and nozzle form. However, it is preferable that the gauge pressure at the inlet of the air interlacing nozzle device is 0.2 MPa or more. A more preferable range is 0.4 to 0.8 MPa. If the pressure is too low, the joining force becomes weak due to insufficient entanglement, and if too high, damage such as filament breakage occurs at the joining portion. Various joining portion patterns as shown in FIGS. 4 to 6 can be obtained by changing the arrangement of the nozzle holes 22 or moving the air interlacing nozzle device in the longitudinal direction of the fiber bundle. A plurality of air interlacing nozzle devices 21 can also be installed for fluid treatment at a plurality of places.

Figure 9:
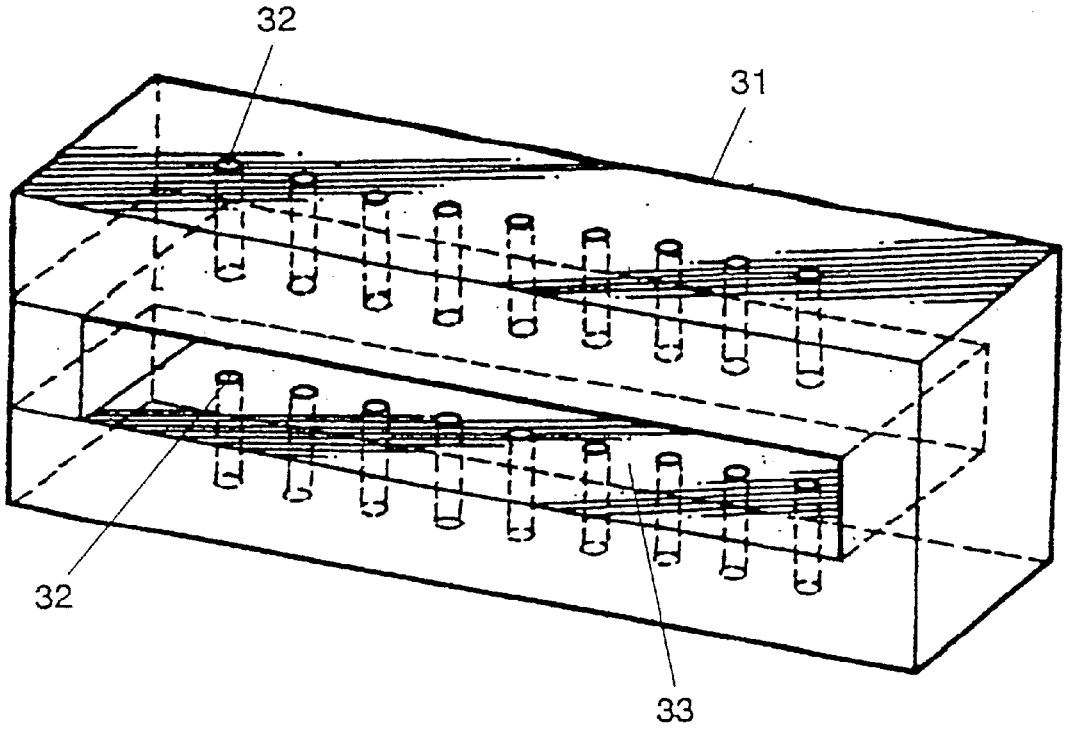
FIG. 9 is a perspective view showing another example of air interlacing nozzle device preferably used for forming a joining portion of precursor fiber bundles for manufacture of carbon fibers in the present invention.
Figure 10:
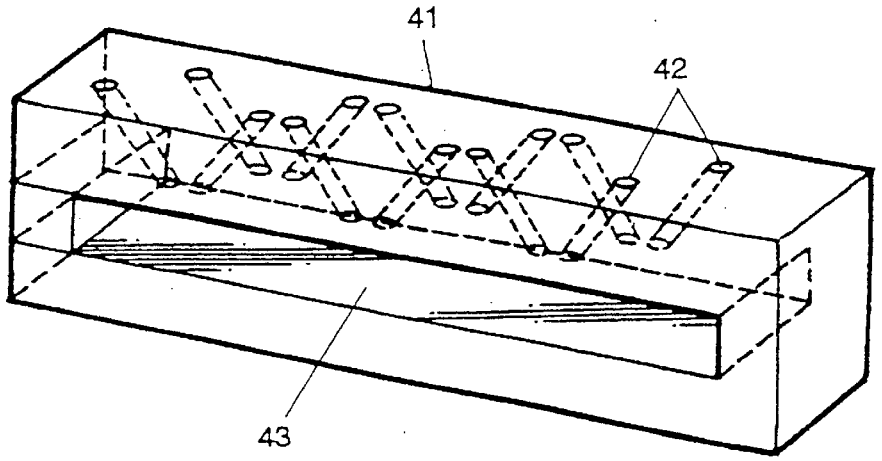
FIG. 10 is a perspective view showing still another example of air interlacing nozzle device preferably used for forming a joining portion of precursor fiber bundles for manufacture of carbon fibers in the present.

FIGS. 9 and 10 are schematic perspective views showing other examples of the air interlacing nozzle devices.

In the example shown in FIG. 9, nozzle holes 32 are arranged at the top and bottom of the nozzle proper 31, to face each other in one row. In the fluid treatment chamber 33, the flatly opened end of a precursor fiber bundle and the flatly opened end of the stabilized fiber bundle are arranged. The air jetted from the nozzle holes 32 makes the individual filaments of the fiber bundles interlaced with each other.

The top and bottom nozzle holes 32 can be positioned to face each other, to let the jetted air collide with each other, or can be displaced to form swirl flow.

In the example shown in FIG. 10, at the top of the nozzle body 41, pairs of slant nozzle holes 42 are formed in a plurality of rows. The air jetted from the respective nozzle holes 42 causes the individual filaments of the flatly opened end of a precursor fiber bundle and the flatly opened end of the stabilized fiber bundle placed in the fluid treatment chamber 43 to be interlace with each other.

Before forming the joining portions 12A and 12B of the precursor fiber bundles 10A and 10B with the intervening fiber bundle 11, these fiber bundles must be overlapped. An example of the device for overlapping them is described below.

Figure 11:
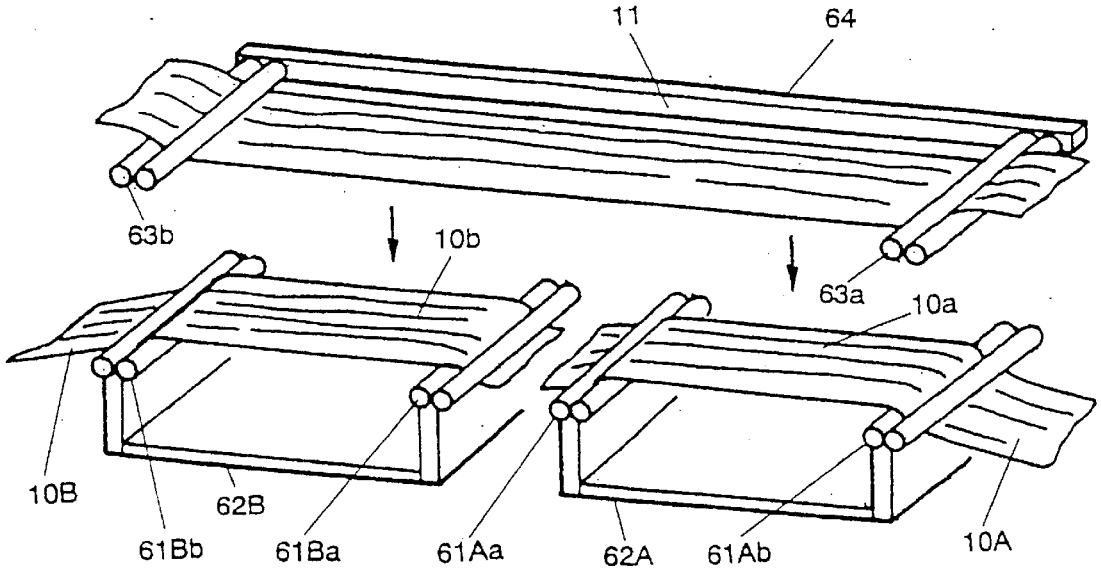
FIG. 11 is a schematic perspective view showing an example of apparatus for manufacturing a precursor fiber bundle for manufacture of carbon fibers in the present invention.
Figure 12:
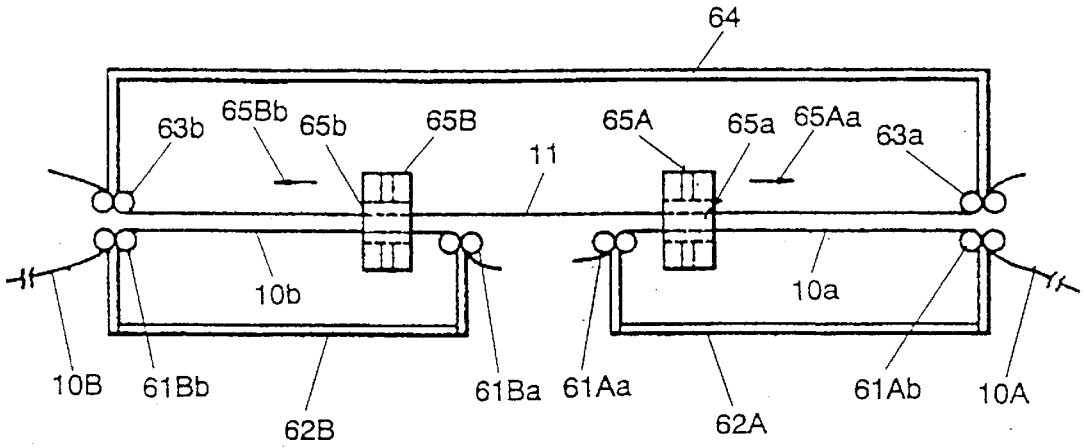
FIG. 12 is a schematic vertical sectional view for illustrating the operation to form joining portions of the precursor fiber bundles for manufacture of carbon fibers by using the apparatus shown in FIG. 11.

FIG. 11 is a typical perspective view showing an example of the overlapping apparatus. FIG. 12 is a schematic vertical sectional view for illustrating the formation of the joining portions by the apparatus shown in FIG. 11.

In FIG. 11, a first fiber bundle holding means 62A has fiber bundle holding bars 61A*a* and 61A*b* located to cross the fiber bundle for holding the terminal end 10*a* of the first precursor fiber bundle 10A at two places apart from each other in the longitudinal direction of the fiber bundle. A second fiber bundle holding means 62B has fiber bundle holding bars 61B*a* and 61B*b* located to cross the fiber bundle for holding the starting end 10*b* of the second precursor fiber bundle 10B at two places apart from each other in the longitudinal direction. The first fiber bundle holding means 62A and the second fiber bundle holding means 62B are located in such a manner that the tip of the terminal end 10*a* of the first precursor fiber bundle 10A and the tip of the starting end 10*b* of the second precursor fiber bundle 10B respectively held by the holding means may face each other.

On the other hand, above the first fiber bundle holding means 62A and the second fiber bundle holding means 62B, an intervening fiber bundle holding means 64 is positioned. The intervening fiber bundle holding means 64 has fiber bundle holding bars 63*a* and 63*b* located to cross the fiber bundle for holding the starting and terminal ends of the intervening fiber bundle 11 at two places apart from each other.

In this state, as shown in FIG. 12, interlacing nozzles 65A and 65B for treating the filaments to interlace them with each other using a fluid are installed in such a manner that the respectively overlaid ends 10*a* and 10*b* and the intervening fiber bundle 11 may be positioned in the treatment chambers 65*a* and 65*b* of the interlacing nozzles 65A and 65B. The air jets from the nozzles 65A and 65B achieve the desired joining conditions. For interlacing filaments with each other by the nozzles 65A and 65B, as required, the nozzles 65A and 65B can also be moved in the longitudinal direction of the fiber bundles as indicated by arrows 65A*a* and 65B*b* in FIG. 12, for treating desired lengths.

The nozzles 65A and 65B may also be actuated one by one or simultaneously. As another method, only one of the nozzles 65A and 65B may also be provided for interlacing treatment of both the portions in succession.

If the precursor fiber bundles 10A and 10B and the intervening fiber bundle 11 held by the first fiber bundle holding means 62A, the second fiber, bundle holding means 62B and the intervening fiber bundle holding means 64 are relaxed to some extent before the fluid treatment by the nozzles 65A and 65B, the filaments are more easily interlaced with each other.

Figure 13:
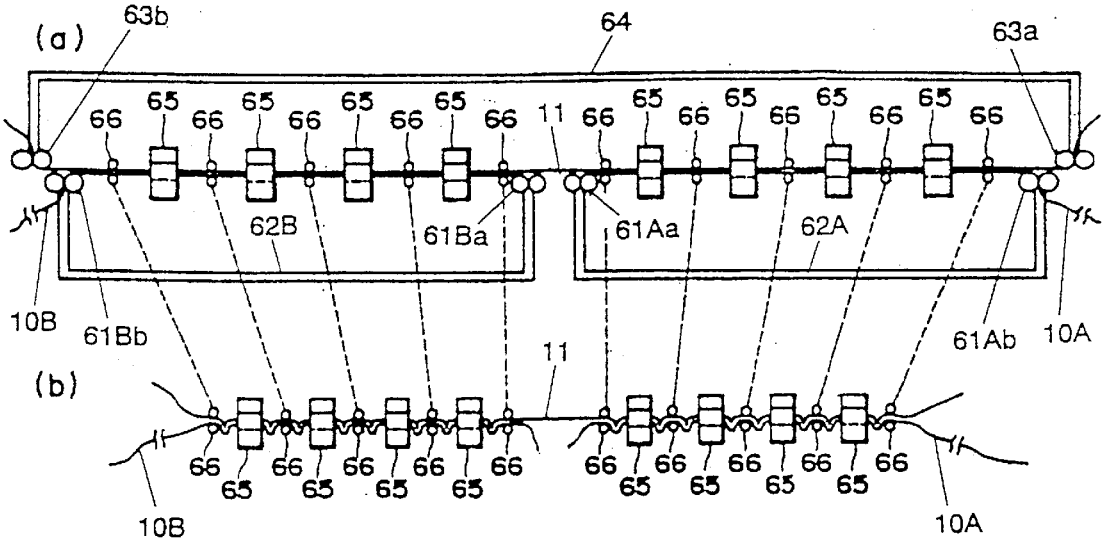
FIG. 13 is a schematic sectional view showing another example of apparatus for manufacturing a precursor fiber bundle for manufacture of carbon fibers in the present invention.

FIG. 13 is a schematic vertical view for illustrating another overlapping device and the method for joining the precursor fiber bundles with the intervening fiber bundle using the apparatus. This apparatus can be preferably used to entangle filaments with each other in a plurality of transverse lines as shown in FIG. 4. As for the fiber bundle joining procedure, both the precursor fiber bundles 10A and 10B and the intervening fiber bundle 11 are held as described for FIG. 11, and both the precursor fiber bundles 10A and 10B and the intervening fiber bundle 11 are overlapped as described with FIG. 12.

Then, as shown in FIG. 13(*a*), at the respective places where entanglement is to be effected, air interlacing nozzles 65 are installed. On both sides of each of the air interlacing nozzles 65, relax holding means 66 are installed at predetermined intervals.

Then, as shown in FIG. 13(*b*), the precursor fiber bundle holding means 61A*a*, 61A*b*, 61B*a* and 61B*b* and the intervening fiber bundle holding means 63*a* and 63*b* are once opened, and the air interlacing nozzles 65 and the relax holding means 66 are respectively moved as shown in FIG. 13(*b*). By this action, the portions to be interlaced of the fiber bundles are relaxed.

In succession, the respective air interlacing nozzles 65 are actuated to achieve entanglement at the respective portions. Thus, the entangled portions are formed at the joining portions 12A and 12B in a plurality of transverse lines at certain intervals in the longitudinal direction as shown in FIG. 4.

According to this method, since the fiber bundles can be relaxed, the filaments are likely to be interlaced with each other to achieve stronger joining. Furthermore, since the relaxation rates at the respective joining portions can be set individually, any desired joining style and strength can be obtained. In the case of the joining style as shown in FIG. 4, it is preferable that the number of interlaced portions is about 3 to 5, for decreasing the fluctuation of joining strength.

In the above joining method, since a stabilized fiber bundle having non-exothermic property at the stabilizing treatment temperature is used as the intervening fiber bundle, the heat generated at the joining portions of the precursor fiber bundles in the stabilizing furnace can be kept small. even if the joining portions become thick to some extent, and such inconveniences as filament breaking due to excessive heat accumulation can be avoided.

As a result, even a precursor fiber bundle consisting of 30,000 or more filaments remarkably thick compared to conventional precursor fiber bundles can be treated to be stabilized without substantially greatly lowering the stabilizing treatment temperature and without lowering the stabilizing treatment speed (fiber bundle running speed). Therefore, finally, a thick carbon fiber bundle can be continuously produced, to allow the production of carbon fibers at low cost. Especially since the ends of the precursor fiber bundles and the intervening fiber bundles are opened flatly when the filaments of the respective fiber bundles are treated to be interlaced with each other for joining the two precursor fiber bundles into one fiber bundle, it does not happen that the fiber bundles are strongly tightened at the knotty joining portions formed by the conventional fiber bundle joining method or at the knotty or distorted joining portions formed by the conventional fluid treatment joining method.

That is, even if the precursor fiber bundles are thick, the joining portions can be formed in such a manner that the calorific value per unit area or unit volume can be kept small. So, also partly because of the use of the intervening fiber bundle having non-exothermic property, the excessive heat generation and heat accumulation at the joining portions can be positively inhibited compared to the conventional methods.

Furthermore, in the conventional methods, the temperature of the stabilizing treatment furnace is lowered considerably when the joining portions pass the furnace, but according to the present invention, it is not necessary to lower the temperature of the stabilizing treatment furnace so much. So, thick precursor fiber bundle can be treated to be stabilized efficiently and stably, to raise the productivity, and therefore, carbon fibers can be produced at low cost.

On the other hand, the method of interlacing the filaments of the precursor fiber bundles and the intervening fiber bundle with each other by fluid treatment with the ends of the respective fiber bundles opened flatly can also be applied even when the mating ends of the precursor fiber bundles are joined directly without using any intervening fiber bundle.

If it is attempted to join the ends of thick precursor fiber bundles by any prior art, the entanglement of filaments achieved by fluid treatment is weak since the number of filaments is too large, and the filament density becomes uneven, to cause heat accumulation and burn due to insufficient binding force and locally high filament densities.

According to the method of the present invention in which the filaments are interlaced with each other by fluid treatment at the mating ends of the fiber bundles opened flatly, even if the mating ends of thick precursor fiber bundles are directly joined, the joining force is very higher compared to that achieved by prior arts, and furthermore, at the joining portion, filaments can be interlaced uniformly with the calorific value per unit area or unit volume kept small, to allow the excessive heat generation and heat accumulation at the joining portion to be inhibited.

The method for directly joining thick precursor fiber bundles with the mating ends opened flatly can be effected basically as described above for the method of joining through an intervening fiber bundle.

As for joining styles, the end 10*a* (terminal end) of the precursor fiber bundle 10A shown in any of FIGS. 4 to 6 can be joined with the end (starting end) of the precursor fiber bundle 10B, instead of the intervening fiber bundle 11. The joining styles of the joining portion can be any of the parallel entanglement shown in FIG. 4, the multi-point entanglement shown in FIG. 5 or the full face entanglement shown in FIG. 6, etc.

As for the interlacing means, as in the case of using an intervening fiber bundle, for example, the air interlacing nozzle device 21 shown in FIG. 8 can be used to have the end (starting end) 10*b* of the precursor fiber bundle 10B overlaid instead of the intervening fiber bundle 11 on the end (terminal end) 10*a* of the precursor fiber bundle 10A of FIG. 8 within the nozzle, and the fluid jetted from the nozzle holes 22 can be applied to open both the overlaid ends for interlacing the individual filaments of the mating ends with each other.

The direct joining between the mating ends of the precursor fiber bundles without using any intervening fiber bundle can be achieved, for example, by a joining method and apparatus similar to those shown in FIGS. 11 and 12. Concretely, the precursor fiber bundle holding means 62A of FIGS. 11 and 12 holds the end (terminal end) 10*a* of the precursor fiber bundle 10A, and the intervening fiber bundle holding means 64 can hold the end (starting end) of the precursor fiber bundle 10B instead of the intervening fiber bundle 11. In this case, the precursor fiber bundle holding means 62B is not necessary.

Then, as shown in FIG. 12, the terminal end 10*a* of the precursor fiber bundle and the starting end 10*b* of the precursor fiber bundle can be overlaid and treated by the air interlacing nozzle devices 65, to interlace the filaments with each other by fluid treatment.

In this case, for reinforcing and uniformizing the entanglement achieved by the fluid treatment, the mating ends (terminal end and starting end) 10*a* and 10*b* of the precursor fiber bundles are opened flatly when held. Especially it is preferable to open flatly at a density of 4,000 filaments/mm or less.

Also in the joining method and apparatus shown in FIG. 13, the intervening fiber bundle holding means 64 can hold the end (starting end) of the precursor fiber bundle 10B instead of the intervening fiber bundle 11, to join the mating ends of the precursor fiber bundles.

In the above mentioned method of joining the mating ends of the precursor fiber bundles through an intervening fiber bundle or directly, since the fiber bundles are opened flatly when treated by a fluid, joining can be effected at a desired joining strength even if the filaments of the precursor fiber bundles to be joined are crimped.

However, crimped precursor fiber bundles are cottony and may have their filaments entangled with each other, and in this case, the filaments of the fiber bundles to be joined are rather less uniformly interlaced with each other.

To solve the problem, it is only required to de-crimp only at the mating ends of the crimped precursor fiber bundles to be joined.

As for the degree of de-crimping, since it is only intended to reinforce the entanglement by fluid treatment, it is sufficient if the filaments are made straight to some extent without being entangled with each other by straightening the crimped cottony fiber bundles having filaments entangled with each other, by applying a tension, and heat-treating them for a short time.

The heat treatment can be effected by any of various methods such as hot air or steam blowing or pressing by a pair of planar heaters, etc.

Figure 14:
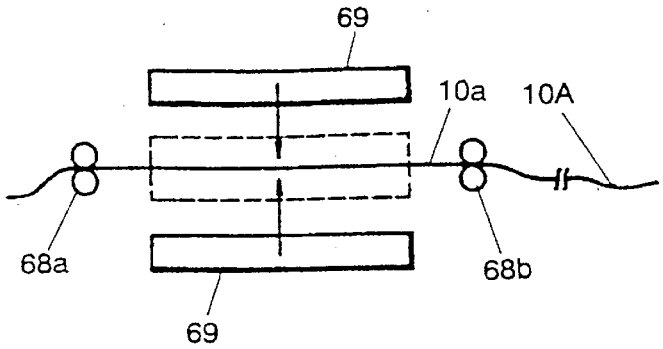
FIG. 14 is a schematic side view showing an example of heat treatment device for removing crimps in a precursor fiber bundle for manufacture of carbon fibers in the present invention.

FIG. 14 is a schematic side view showing an example of the heat treatment device for effecting the heat treatment. In FIG. 14, the end 10*a* of the crimped precursor fiber bundle 10A is held by fiber bundle holding means 68*a* and 68*b*. Then, the precursor fiber bundle holding means 68*a* and 68*b* are moved in the respectively opposite directions in the longitudinal direction of the fiber bundle, so that the crimps in the end 10*a* of the precursor fiber bundle 10A in the portion held between the fiber bundle holding means 68*a* and 68*b* may be pulled to vanish. In this case, the fiber bundle holding means 68*a* and 68*b* may be moved to achieve a predetermined distance or to apply a predetermined tension to the fiber bundle.

Subsequently, the end 10*a* of the fiber bundle 10A is caught between planar heaters 69 on both sides, to be de-crimped. The temperature of the planar heaters 69 is 80° C. to 180° C., preferably 100° C. to 150° C., and the heat treatment time can be 3 to 10 seconds.

Since the de-crimping means shown in FIG. 14 is very simple, it can be easily installed in any of the joining apparatuses shown in FIGS. 11, 12 and 13.

When the precursor fiber bundles are directly joined, the density of the precursor fibers at the joining portion is doubled, compared to the method of joining through an intervening fiber bundle having non-exothermic property at the stabilizing treatment temperature. So, heat is likely to be accumulated compared to the case of using an intervening fiber bundle.

To reduce the heat accumulation, it is desirable to give a stabilization reaction inhibitor to the directly joined portion of the thick precursor fiber bundles.

If a stabilization reaction inhibitor is applied, heat generating reaction is inhibited to allow the heat accumulation at the joining portion to be inhibited, and the filament burn, breaking, etc. in the stabilizing treatment process can be avoided. It is preferable to use boric acid water as the stabilizing reaction inhibitor.

As described above, a fluid can be used for making filaments substantially uniformly interlaced with each other to join the ends of two precursor fiber bundles through an intervening fiber bundle or to directly join the mating ends of two precursor fiber bundles. Filaments can also be interlaced with each other by using a needle punch as described below.

The filaments at the flatly opened end of a precursor fiber bundle and the flatly opened end of an intervening fiber bundle or the filaments at the flatly opened mating ends of two precursor fiber bundles can be substantially uniformly entangled with each other even by overlaying those ends of the fiber bundles and treating the overlaid portions by a needle punch instead of a fluid. The filament interlacing treatment using a needle punch can be applied to all the above mentioned cases of filament interlacing treatment using a fluid, instead of the filament interlacing treatment using a fluid.

The needle punch used can be any conventionally known needle punch. Spined needles are moved in the direction perpendicular to the fiber bundles, to dislocate the filaments constituting the fiber bundles by the tips or spines of the needles, and as a result, the filaments are interlaced with each other three-dimensionally. A desired joining force can be obtained at the joining portion by optimizing the number of needle punching times, needle density and needle form.

For example, the joining portions of a series of precursor fiber bundles with an intervening fiber bundle as shown in FIG. 4 can be formed by needle punches as described below. The terminal end 10*a* of the precursor fiber bundle 10A and the starting end of the intervening fiber bundle (stabilized fiber bundle) 11 are overlaid each other, and the starting end 10*b* of the precursor fiber bundle 10B and the terminal end of the intervening fiber bundle 11 are overlaid each other, respectively as described for FIG. 11.

Figure 15:
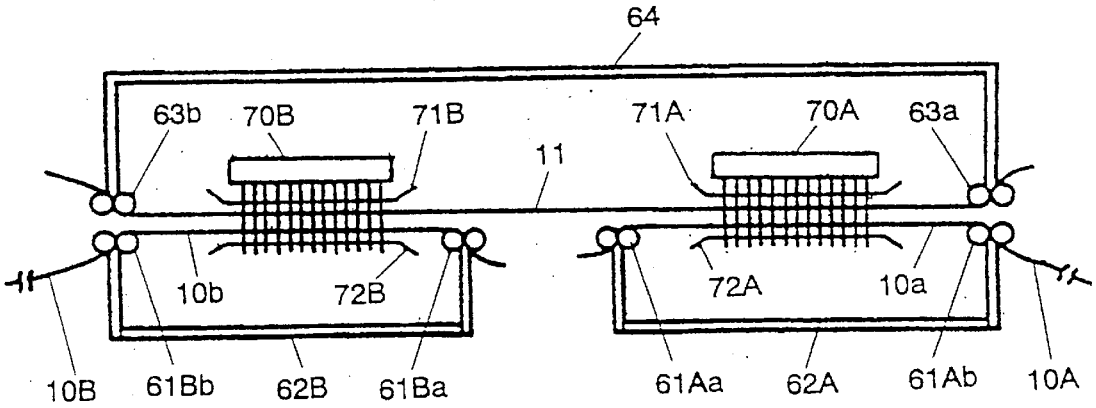
FIG. 15 is a schematic vertical sectional view showing still another example of apparatus for manufacturing a precursor fiber bundle for manufacture of carbon fibers in the present invention.

FIG. 15 is a schematic vertical sectional view for illustrating the formation of joining portions by the apparatus shown in FIG. 11. The joining portions in FIG. 15 can be formed by using needle punches for filament interlacing treatment instead of the interlacing nozzles 65A and 65B of FIG. 12.

In FIG. 15, needle punches 70A and 70B are installed in such a manner that the ends 10*a* and 10*b* and the intervening fiber bundle 11 respectively overlapped may be arranged in a needle punch treatment chamber, and the filaments of the overlaid fiber bundles are interlaced with each other by the needle punches. Stripper plates 71A and 71B and bed plates 72A and 72B hold the overlapped fiber bundles between them, and needle beams move vertically for needle punching.

EXAMPLES

The present invention is described below more concretely in reference to examples.

To confirm the effect of the present invention, a stabilizing treatment furnace was used to perform the following stabilizing treatment furnace passing test of precursor fiber bundles.

The precursor fiber bundle contained in a first can was introduced into the stabilizing furnace and treated to be stabilized at a predetermined temperature for a predetermined residence time. At the place where the first can existed, a second can containing the next precursor fiber bundle was arranged, and the terminal end of the precursor fiber bundle contained in the first can was joined with the starting end of the next precursor fiber bundle according to the precursor fiber bundle joining method described below in detail.

The joining portions passed over guide bars and through a drive station and went into the stabilizing treatment furnace. The stabilizing treatment time was 60 minutes, and the temperature in the stabilizing treatment furnace was changed to measure the upper limit temperature at which the fiber bundle could pass. The stabilizing process passing rate at the upper limit temperature was measured. Since the controlled furnace temperature could vary in a certain range, the temperature was measured every 5° C.

The joining portions coming out of the stabilizing treatment furnace were then treated to be carbonized in a carbonizing treatment furnace in nitrogen atmosphere at 1500° C., and the carbon fiber bundle coming out of the carbonizing treatment furnace was wound around a bobbin by a winder.

The tension acting on the precursor fiber bundle in the stabilizing treatment furnace was about 6 kgf/st in the beginning stage, and became about 9 kgf/st at ending stage since the fiber bundle was shrunken.

The precursor fiber bundles to be stabilized were polyacrylic precursor fiber bundles of 1.5 deniers consisting of 70,000 filaments respectively. To ensure that the fiber bundles could be taken out of the cans easily and could go through the passage easily, they had crimps.

The conditions and results of examples and comparative examples are listed in Table 1.

The precursor fiber bundle consisting of 70,000 (70K) filaments (without any joining portion) was used as a blank to measure the upper limit temperature at which it could pass through the stabilizing treatment furnace, and the process passing rate. The upper limit temperature to allow stabilization was 235° C., and when the stabilizing temperature was set at 240° C., the precursor fiber bundle was broken by burning. At a stabilizing temperature of 235° C., both the process passing rates through the stabilizing process and the carbonizing process were 100%.

Example

The mating ends of precursor fiber bundles respectively consisting of 70,000 filaments were joined using a stabilized fiber bundle. In this case, four intervening stabilized fiber bundles consisting of 36,000 filaments, 48,000 filaments, 60,000 filaments or 100,000 filaments were prepared.

For joining, the de-crimping means of FIG. 14 and the fiber bundle joining apparatus of FIG. 13 were used for joining in a style as shown in FIG. 4. The filaments were interlaced with each other in 4 transverse lines at each overlaid portion as shown in FIG. 4. The procedure was as follows:

(i) The de-crimping means of FIG. 14 was used to de-crimp the ends of the precursor fiber bundles. The bundles were pulled while being pressed from both sides by planar heaters of 100° C. to 130° C. in surface temperature for 5 seconds.

(ii) As shown in FIG. 13(*a*), the ends of the de-crimped precursor fiber bundles and the intervening stabilized fiber bundles were respectively opened flatly to a width of 25 mm (widened) and overlaid each other.

(iii) As shown in FIG. 13(*b*), the fiber bundles were relaxed in the longitudinal direction at the portions to be interlaced by air, and compressed air was jetted from the respective air interlacing nozzles 65A and 65B, for interlacing treatment. The air interlacing nozzles used were as shown in FIG. 9, and had an interlacing treatment space width of 50 mm and a clearance of 6 mm. The pressure of the compressed air jetted from the nozzles was 0.5 MPa at the supply source.

(iv) The encumbering extra portions at the respective ends of the joined precursor fiber bundles and the stabilized fiber bundle were removed by cutting, to form joining portions as shown in FIG. 4.

At the joining portions formed like this, the filaments of the air interlaced portions were sufficiently uniformly mixed and interlaced with each other, and it did not happen that sub-bundles of filaments were distortedly interlaced with each other.

(v) The series of precursor fiber bundles with joining portions formed like this were passed though the stabilizing treatment furnace, to measure the upper limit temperature to allow passing.

(vi) Joining portions of precursor fiber bundles were prepared under the same conditions, and at the upper limit temperature to allow passing through the stabilizing treatment furnace, the stabilizing process passing rate and the carbonizing process passing rate of the joining portions were measured.

As shown in Table 1, compared to the blank, the upper limit to allow the passing of the precursor fiber bundles through the stabilizing treatment furnace was equivalent or lower by about 5° C., and the temperature decline could be kept very small.

Furthermore, with the temperature of the stabilizing treatment furnace set at the upper limit temperature to allow passing, the one precursor fiber bundle formed by joining like this was fed through the stabilizing treatment furnace, and the stabilized fiber bundle obtained was fed through the carbonizing treatment furnace. The carbon fiber bundle obtained was wound around a bobbin by a winder.

Since the interlaced portions at the joining portions were flat and since the filaments were interlaced with each other uniformly, the fiber bundle could be well positioned in the grooves of the grooved rollers used to support and feed the fiber bundle in both the furnaces.

Comparative Example 1

Figure 1:
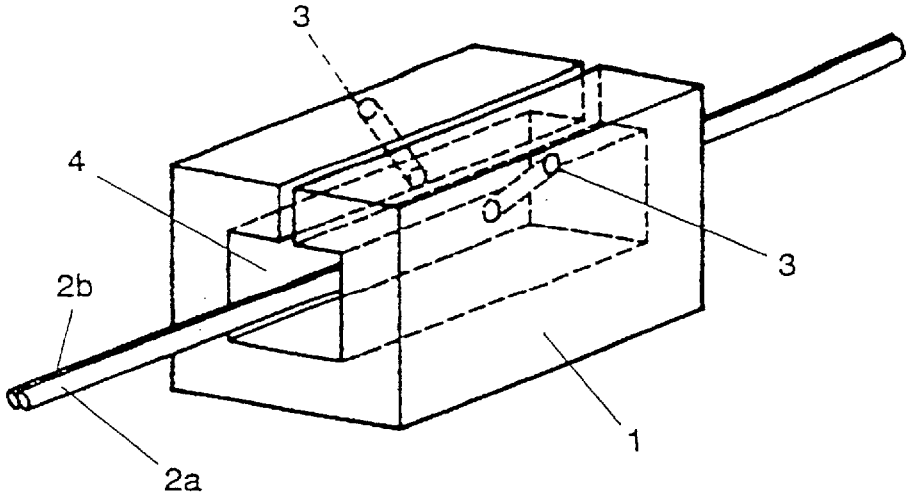
Fig. 1 (Prior Art)
FIG. 1 is a perspective view showing a conventional interlacing nozzle for interlacing precursor fiber bundles for manufacture of carbon fibers.

The mating ends of precursor fiber bundles respectively consisting of 70,000 filaments were joined by the air interlacing method described in Japanese Patent Publication (Kokoku) No. 1-12850. The air interlacing nozzle used had a structure shown in FIG. 1, and its interlacing treatment chamber and nozzle holes were interlaced to suit the fiber bundles consisting of many filaments. The filaments were entangled with each other in four transverse lines at the overlaid portion of the fiber bundles to be joined, as described for Example 1. The overlapped fiber bundles to be joined were arranged in the interlacing treatment chamber of the air interlacing nozzle, and treated to be interlaced with each other by the air supplied to the nozzle at a compressed air pressure of 0.5 MPa.

In the air interlacing treatment by this method, the fiber bundles were divided into sub-bundles consisting of filaments, and the sub-bundles consisting of filaments were distortedly interlaced with each other.

The one precursor fiber bundle formed by joining like this was measured as described for Example 1, to identify its upper limit temperature to allow passing through the stabilizing treatment furnace and the process passing rates.

The distortedly air interlaced portions were likely to accumulate heat and burn in the stabilizing treatment furnace, and the upper limit temperature to allow passing through the stabilizing treatment furnace was 220° C., being very low compared to the blank. The joining force at the joining portion was very low compared to Example 1 and greatly varied. So, in the stabilizing treatment furnace passing test at 220° C., many hollow portions were formed in the joining portion and breaking at the joining portion occurred frequently.

Comparative Example 2

The mating ends of precursor fiber bundles respectively consisting of 70,000 filaments were joined using an intervening stabilized fiber bundle consisting of 60,000 filaments, according to the air interlacing method described in Japanese Patent Publication No. 1-12850. The joining method was as described for Comparative Example 1.

In the air interlacing treatment by this method, the precursor fiber bundles and the stabilized fiber bundle were respectively divided into sub-bundles consisting of filaments as caused in Comparative Example 1, and the sub-bundles consisting of filaments were distortedly interlaced with each other.

The precursor fiber bundle obtained like this was measured as described for Example 1, to identify its upper limit temperature to allow passing through the stabilizing treatment furnace and the process passing rates.

Compared to Comparative Example 1, the effect of inhibiting heat accumulation in the stabilizing treatment furnace by the intervening stabilized fiber bundle was observed, and the upper limit temperature to allow passing through the stabilized treatment furnace became 225° C., but the temperature was very low compared to the blank. Furthermore, as in Comparative Example 1, the joining force at the joining portion was very low compared to Example 1 and greatly varied. So, in the stabilizing treatment furnace passing test at 225° C., many hollows were formed in the joining portion and breaking at the joining portion occurred frequently.

From Example 1 and Comparative Examples 1 and 2 described above, it can be seen that the joining method of the present invention, compared to the prior arts, can enhance the joining strength of the joining portions and can uniformly mutually mix and interlace the filaments of the fiber bundles to be joined, while achieving the effect of inhibiting the heat accumulation.

Especially as can be seen from the results of (1) to (4) of Example 1, it is preferable that the number of filaments F of the intervening stabilized fiber bundle and the number of filaments G of each of the precursor fiber bundles are in a range of $0.4 \times G \leqq F \leqq 1.5 \times G$, and that it is especially preferable that the range is $0.6 \times G \leqq F \leqq 1.0 \times G$.

Example 2

An intervening stabilized fiber bundle consisting of 60,000 (60K) filaments was used to join the mating ends of precursor fiber bundles respectively consisting of 70,000 filaments (70K). The joining was effected according to the procedure (i) to (iv) as described in Example 1, except that the ends of the respective fiber bundles were opened flatly to a width of 14 mm instead of 25 mm.

The joining portions prepared according to this joining method had the filaments less uniformly mixed and interlaced with each other at the air interlaced portions. The upper limit temperature to allow passing through the stabilizing furnace and the process passing rates were slightly lower than those of (3) of Example 1, but were very higher than those of Comparative Example 2.

As shown in Table 1, the filament density at the flatly opened mating ends of respective fiber bundles before air interlacing treatment was larger than 4,000 filaments/mm in Example 2, but 4,000 filaments/mm or less in Examples 1, 3 and 4. As can be seen from the comparison of these examples, it is preferable that the filament density at the flatly opened mating ends of the respective fiber bundles to be joined is 4,000 filaments/mm or less.

Example 3

The mating ends of precursor fiber bundles respectively consisting of 70,000 filaments were directly joined without using any intervening stabilized fiber bundle.

The joining method was similar to that of Example 1, but instead of overlaying the ends of precursor fiber bundles with an intervening fiber bundle (stabilized fiber bundle), the mating ends of precursor fiber bundles were directly overlaid, and the filaments were entangled with each other in four transverse lines.

The joining portion formed like this had the filaments sufficiently uniformly mixed and interlaced with each other at the air interlaced portions, and it did not happen that sub-bundles consisting of filaments were distortedly interlaced with each other.

The one precursor fiber bundle formed by joining like this was passed through the stabilizing treatment furnace, to measure the upper limit temperature to allow passing.

Since the filament density of the precursor fiber bundle at the joining portion was high, the joining portion was likely to accumulate heat, and the upper limit temperature to allow passing through the stabilizing treatment furnace was 225° C. The upper limit to allow passing through the stabilizing treatment furnace was lower than that of the blank, but was very higher than that of Comparative Example 1. Furthermore, with the temperature of the stabilizing treatment furnace set at the upper limit temperature of 225° C., the precursor fiber bundle was treated to be stabilized and then treated to be carbonized. The carbon fiber bundle obtained by letting the fiber bundle pass through the stabilizing treatment process and the carbonizing treatment process was wound around a bobbin by a winder.

Especially since the interlaced portions at the joining portion were flat and since the filaments were uniformly interlaced with each other, the fiber bundle could be well positioned in the grooves of the grooved rollers used in both the processes. This method is lower in productivity than the method of using an intervening fiber bundle (stabilized fiber bundle), but since it is simple compared to the method of Example 1, it can be sufficiently applied for production when the temperature of the stabilizing treatment furnace may be lowered to some extent.

Example 4

As described for Example 3, the mating ends of precursor fiber bundles respectively consisting of 70,000 filaments were directly joined, and then boric acid water was applied to the joining portion as a stabilizing reaction inhibitor.

The upper limit temperature to allow passing through the stabilizing treatment furnace was 235° C. The fiber bundle could be passed through the stabilizing treatment furnace under an equivalent condition to that of the blank.

However, at the portion with boric acid water applied, stabilization is retarded since the reaction is inhibited. So, if the stabilized fiber bundle is treated to be carbonized, it may be cut by burning. So, if the joining portion is treated by boric acid water, it is preferable to cut and remove the boric acid water treated portion of the obtained stabilized fiber bundle after stabilizing treatment, and re-join the cut segments.

Example 5

As described for Example 1, precursor fiber bundles and an intervening stabilized fiber bundle were prepared. For joining the fiber bundles, needle punches were used instead of the air interlacing nozzles used as a joining means in Example 1. As shown in FIG. 15, the overlapped portions of the respective fiber bundles were needle-punched to have their filaments interlaced with each other.

The encumbering extra portions at the ends of the joined precursor fiber bundles and the stabilized fiber bundle were removed by cutting, to obtain joining portions as shown in FIG. 4.

The joining portions formed like this had the filaments sufficiently uniformly mixed and interlaced with each other at the needle punched interlaced portions, and it did not happen that sub-bundles consisting of filaments were distortedly interlaced with each other.

The precursor fiber bundle with joining portions formed like this was passed through the stabilizing treatment furnace, to measure the upper limit temperature to allow passing.

Joining portions of precursor fiber bundles were prepared under the same conditions, and at the upper limit temperature to allow passing through the stabilizing treatment furnace, the stabilizing process passing rate and the carbonizing process passing rate of the joining portions were measured.

As shown in Table 2, compared to the blank (see Table 1), the upper limit temperature of the precursor fiber bundle to allow passing through the stabilizing treatment furnace was equivalent or lower by about 5° C., and the temperature decline could be kept very small.

Furthermore, with the temperature of the stabilizing treatment furnace set at the upper limit temperature to allow passing, the one precursor fiber bundle formed by joining like this was passed through the stabilizing treatment furnace, and the obtained stabilized fiber bundle was passed through a carbonizing treatment furnace. The obtained carbon fiber bundle was wound around a bobbin by a winder.

Especially since the interlaced portions at the joining portions were flat and since the filaments were uniformly interlaced with each other, the fiber bundle could be well positioned in the grooves of the grooved rollers used to support and feed the fiber bundle in both the furnaces.

Example 6

As described for Example 2, precursor fiber bundles and an intervening stabilized fiber bundle were prepared. For joining these fiber bundles, needle punches were used instead of the air interlacing nozzles used in Example 2 as a joining means. As shown in FIG. 15, the overlapped portions of the respective fiber bundles were needle-punched to have the filaments interlaced with each other.

The joining portions prepared by this joining method had the filaments less uniformly mixed and interlaced with each other at the needle punched portions compared to those of (3) of Example 5. The upper limit temperature to allow passing through the stabilizing furnace and the process passing rates were somewhat lower than those of (3) of Example 5 but were very higher than those of Comparative Example 2.

As shown in Table 2, the filament density at the flatly opened ends of the respective fiber bundles before needle punching was as large as more than 4,000 filaments/mm, but it was 4,000 filaments/mm or less in Examples 5, 7 and 8. It can be seen from the comparison of these examples, it is preferable that the filament density at the flatly opened ends of the respective fiber bundles to be joined is 4,000 filaments/mm or less.

Example 7

As described for Example 3, precursor fiber bundles were prepared. For joining the fiber bundles, a needle punch was used instead of using the air interlacing nozzles used as a joining means in Example 3. The joining means is the same as that of Example 5, but the mating ends of the precursor fiber bundles were overlaid and joined instead of overlapping the precursor fiber bundles with the stabilized fiber bundle. The length of the joining portion formed by the needle punch was about 30 cm.

The joining portion formed like this had the filaments sufficiently uniformly mixed and interlaced with each other at the needle punched portion, and it did not happen that sub-bundles consisting of filaments were distortedly interlaced with each other.

The one precursor fiber bundle formed by joining like this was passed through the stabilizing treatment furnace, to measure the upper limit temperature to allow-passing through.

Since the filament density of the precursor fiber bundles at the joining portion was high, the joining portion was likely to reserve heat, and the upper limit to allow passing through the stabilizing treatment furnace was 225° C. The upper limit to allow passing through the stabilizing treatment furnace was lower than that of the blank (see Table 1), but was very higher than that of Comparative Example 1 (see Table 1). Furthermore, with the temperature of the stabilizing treatment furnace set at the upper limit temperature of 225° C., the precursor fiber bundle was treated to be stabilized and treated to be carbonized. The carbon fiber bundle obtained by letting the fiber bundle pass through the stabilizing treatment process and the carbonizing treatment process was wound around a bobbin by a winder.

Especially since the interlaced portion at the joining portion was flat and since the filaments were uniformly interlaced with each other, the fiber bundle could be well positioned on the grooves of the grooved rollers used in both the processes. This method is lower in productivity than the method of using an intervening fiber bundle (stabilized fiber bundle), but since it is simple compared to Example 5, it can be sufficiently applied to production in a case where the temperature of the stabilizing treatment furnace is allowed to be lowered to some extent.

Example 8

As described for Example 7, the mating ends of precursor fiber bundles were directly joined, and then boric acid water was applied to the joining portion as a stabilizing reaction inhibitor.

The upper limit temperature to allow passing through the stabilizing treatment furnace was 235° C. The fiber bundle could be passed through the stabilizing treatment furnace under an equivalent condition to that of the blank (see Table 1).

However, at the portion with boric acid water applied, stabilization is retarded since the reaction is inhibited. So, if the stabilized fiber bundle is treated to be carbonized, it may be cut by burning. So, if the joining portion is treated by boric acid water, it is preferable to cut and remove the boric acid water treated portion of the obtained stabilized fiber bundle after stabilizing treatment, and re-join the cut segments.

TABLE 1

| | First and second fiber bundles/ intervening fiber bundle | | Joining method |
|---|---|---|---|
| Blank | 70 K precursor fiber bun41es without any joining portion | | — |
| Example 1 | | | |
| (1) | 70 K precursor fiber bundles/36 K stabilized fiber bundle | | Joining method and appartus using air interlacing nozzles of the present invention |
| (2) | 70 K precursor fiber bundles/48 K stabilized fiber bundle | | |
| (3) | 70 K precursor fiber bundles/60 K stabilized fiber bundle | | |
| (4) | 70 K precursor fiber bundles/100 K stabilized fiber bundle | | |
| Example 2 | 70 K precursor fiber bundles/60K stabilized fiber bundle | | |
| Example 3 | 70 K precursor fiber bundles directly joined | | |
| Example 4 | 70 K precursor fiber bundles directly joined with boric acid water applied | | |
| Comparative Example 1 | 70 K precursor fiber bundles directly joined | | Joining method and apparatus using a conventional air interlacing nozzle (2 nozzle holes) |
| Comparative Example 2 | 70 K precursor fiber bundles/60 K stabilized fiber bundle | | |
| | (a): Open width (mm) of the ends of the first and second fiber bundles and the intervening fiber bundle (b): Filament density (filaments/mm) at the ends of the first and second fiber bundles in the transverse | Stabilizing process process | Carbonizing |

TABLE 1-continued

| | direction (c): Filament density (filaments/mm) at the ends of the intervening fiber bundle in the transverse direction respectively before air interlacing treatment | | Upper Limit temperature to allow passing through process (° C.) | Process passing rate (%) | Process passing rate (%) |
|---|---|---|---|---|---|
| Blank | | — | 235 | 100 | 100 |
| Example 1 | | | | | |
| (1) | (a) | 25 | 235 | 93 | 90 |
| | (b) | 2,800 | | | |
| | (c) | 1,500 | | | |
| (2) | (a) | 25 | 235 | 100 | 100 |
| | (b) | 2,800 | | | |
| | (c) | 1,900 | | | |
| (3) | (a) | 25 | 235 | 100 | 100 |
| | (b) | 2,800 | | | |
| | (c) | 2,400 | | | |
| (4) | (a) | 25 | 230 | 99 | 95 |
| | (b) | 2,800 | | | |
| | (c) | 4,000 | | | |
| Example 2 | (a) | 14 | 230 | 93 | 90 |
| | (b) | 5,000 | | | |
| | (c) | 4,300 | | | |
| Example 3 | (a) | 25 | 225 | 99 | 95 |
| | (b) | 2,800 | | | |
| | (c) | — | | | |
| | (a): Open width (mm) of the ends of the first and second fiber bundles and the intervening fiber bundle | | Stabilizing process process | | Carbonizing |
| | (b): Filament density (filaments/mm) at the ends of the first and second fiber bundles in the transverse direction | | | | |
| | (c): Filament density (filaments/mm) at the ends of the intervening fiber bundle in the transverse direction respectively before air interlacing treatment | | Upper Limit temperature to allow passing through process (° C.) | Process passing rate (%) | Process passing rate (%) |
| Example 4 | (a) | 25 | 235 | 99 | *1 |
| | (b) | 2,800 | | | |
| | (c) | — | | | |
| Comparative Example 1 | | 220 | 40 | *2 | |
| Comparative Example 2 | | — | 225 | 40 | *2 |

Note: K stands for 1,000 filaments.

Note *1. Since the stabilizing conditions were set to allow passing through the stabilizing process, the fiber bundle passed the stabilizing process, but since it had no properties of stabilized fibers, it was not treated to be carbonized.

Note *2. Since the fiber bundle passing rate in the stabilizing process was low, the fiber bundle was not treated to be carbonized.

TABLE 2

| | First/second fiber bundles/ intervening fiber bundle | | | Joining method |
|---|---|---|---|---|
| Example 5 | | | | |
| (1) | 70 K precursor fiber bundles/36 K stabilized fiber bundle | | | Joining method and appartus using needle punches of the present invention |
| (2) | 70 K precursor fiber bundles/48 K stabilized fiber bundle | | | |
| (3) | 70 K precursor fiber bundles/60 K stabilized fiber bundle | | | |
| (4) | 70 K precursor fiber bundles/100 K stabilized fiber bundle | | | |
| Example 6 | 70 K precursor fiber bundles/60K stabilized fiber bundle | | | |
| Example 7 | 70 K precursor fiber bundles directly joined | | | |
| Example 8 | 70 K precursor fiber bundles directly joined with boric acid water applied | | | |
| | (a): Open width (mm) of the ends of the first and second fiber bundles and the intervening fiber bundle | Stabilizing process process | | Carbonizing |
| | (b): Filament density (filaments/mm) at the ends of the first and second fiber bundles in the transverse direction | | | |
| | (c): Filament density (filaments/mm) at the ends of the intervening fiber bundle in the transverse direction respectively before air interlacing treatment | Upper Limit temperature to allow passing through process (° C.) | Process passing rate (%) | Process passing rate (%) |
| Blank | | | | |
| Example 5 | | | | |
| (1) | (a) 25 | 235 | 92 | 88 |
| | (b) 2,800 | | | |
| | (c) 1,500 | | | |
| (2) | (a) 25 | 235 | 100 | 100 |
| | (b) 2,800 | | | |
| | (c) 1,900 | | | |
| (3) | (a) 25 | 235 | 100 | 100 |
| | (b) 2,800 | | | |
| | (c) 2,400 | | | |
| (4) | (a) 25 | 230 | 97 | 96 |
| | (b) 2,800 | | | |
| | (c) 4,000 | | | |
| | (a): Open width (mm) of the ends of the first and second fiber bundles and the intervening fiber bundle | Stabilizing process process | | Carbonizing |
| | (b): Filament density (filaments/mm) at the ends of the first and second fiber bundles in the transverse direction | | | |
| | (c): Filament density (filaments/mm) at the ends of the | Upper Limit temperature to allow passing through process (° C.) | Process passing rate (%) | Process passing rate (%) |

TABLE 2-continued

| | | | | | |
|---|---|---|---|---|---|
| | intervening fiber bundle in the transverse direction respectively before air interlacing treatment | | | | |
| Example 6 | | | | | |
| | (a) | 25 | 230 | 91 | 88 |
| | (b) | 5.000 | | | |
| | (c) | 4,300 | | | |
| Example 7 | (a) | 25 | 225 | 99 | 95 |
| | (b) | 2,800 | | | |
| | (c) | — | | | |
| Example 8 | (a) | 25 | 235 | 99 | *1 |
| | (b) | 2,800 | | | |
| | (c) | — | | | |

Note: K stands for 1,000 filaments.
Note *1. Since the stabilizing conditions were set to allow passing through the stabilizing process, the fiber bundle passed the stabilizing process, but since it had no properties of stabilized fibers, it was not treated to be carbonized.

INDUSTRIAL APPLICABILITY

The precursor fiber bundle for manufacture of carbon fibers of the present invention is one fiber bundle in which a plurality of precursor fiber bundles for manufacture of carbon fibers, respectively consisting of 30,000 or more filaments are joined at their respective mating ends directly or through an intervening fiber bundle (for example, a stabilized fiber bundle) having non-exothermic property at the stabilizing treatment temperature, and at the respective joining portions, the filaments of the respective adjacent fiber bundles are individually interlaced with each other.

The one continuous fiber bundle for manufacture of carbon fibers is thicker than the conventional fiber bundles, but is smaller in the heat accumulation at the joining portions in the stabilizing treatment process, being less likely to burn at the joining portions. So, stabilizing process can be effected continuously at a higher temperature, to allow supply of less expensive carbon fibers.

What is claimed is:

1. A precursor fiber bundle for manufacture of carbon fibers, comprising a first precursor fiber bundle for manufacture of carbon fibers, said first precursor fiber bundle having 30,000 or more filaments and having a flatly opened undivided terminal end wherein said terminal end is the only portion of said first precursor fiber bundle flatly opened, a second precursor fiber bundle for manufacture of carbon fibers, said second precursor fiber bundle having 30,000 or more filaments and having a flatly opened undivided starting end wherein said starting end is the only portion of said second precursor fiber bundle flatly opened, an intervening fiber bundle comprising many filaments having a non-exothermic property at stabilizing treatment temperature, said intervening fiber bundle having a flatly opened undivided starting end and a flatly opened undivided terminal end wherein the terminal end of said first precursor fiber bundle and the starting end of said second precursor fiber bundle are joined through said intervening fiber bundle; and at a first joined portion where the terminal end of said first precursor fiber bundle and the starting end of said intervening fiber bundle are joined and at a second joined portion where the starting end of said second precursor fiber bundle and the terminal end of said intervening fiber bundle are joined, the individual filaments of said undivided ends of said respective fiber bundles are substantially uniformly interlaced with each other, wherein said interlacing of filaments is in a pattern selected from the group consisting of continuous substantially uniform interlacing in the transverse direction of said fiber bundles, interlacing at many joints on the joining portion, and interlacing of the entire face of said joining portion.

2. A precursor fiber bundle for manufacture of carbon fibers according to claim 1, wherein said intervening fiber bundle comprises a stabilized fiber bundle.

3. A precursor fiber bundle for manufacture of carbon fibers according to claim 2, wherein a relation of $0.4\times G \leqq F \leqq 1.5\times G$ is satisfied where F is the number of filaments of said stabilized fiber bundle and G is the number of filaments of each of said precursor fiber bundles for manufacture of carbon fibers.

4. A precursor fiber bundle for manufacture of carbon fibers according to claim 1, wherein said filaments of each said precursor fiber bundles for manufacture of carbon fibers have crimps, the crimps are removed at said joined portions.

5. A precursor fiber bundle for manufacture of carbon fibers, comprising a first precursor fiber bundle for manufacture of carbon fibers, said first precursor fiber bundle having 30,000 or more filaments and having a flatly opened undivided terminal end wherein said terminal end is the only portion of said first precursor fiber bundle flatly opened, and a second precursor fiber bundle for manufacture of carbon fibers, said second precursor fiber bundle having 30,000 or more filaments and having a flatly opened undivided starting end wherein said starting end is the only portion of said second precursor fiber bundle flatly opened, wherein the terminal end of said first precursor fiber bundle and the starting end of said second precursor fiber bundle are directly joined, and at a joined portion where the terminal end of said first precursor fiber bundle and the starting end of said second precursor fiber bundle are joined, the individual filaments of said undivided ends of said respective precursor fiber bundles are substantially uniformly interlaced with each other and said interlacing of filaments is in a pattern selected from the group consisting of continuous substantially uniform interlacing in the transverse direction of said fiber bundles, interlacing at many joints on the joining portion, and interlacing of the entire face of said joining portion.

6. A precursor fiber bundle for manufacture of carbon fibers according to claim 5, wherein where said filaments of each of said precursor fiber bundles for manufacture of carbon fibers have crimps, the crimps are removed at said joined portion.

7. An apparatus for producing a precursor fiber bundle for manufacture of carbon fibers, comprising (a) a first fiber bundle holding means for holding a flatly opened terminal end of a first precursor fiber bundle for manufacture of carbon fibers, said first precursor fiber bundle having 30,000 or more filaments, in the transverse direction of the terminal end, at least at two positions apart from each other in the longitudinal direction, wherein said first fiber bundle holding means comprises a first flat holding element for flatly opening said first precursor fiber bundle at said terminal end, (b) a second fiber bundle holding means for holding a flatly opened starting end of a second precursor fiber bundle for manufacture of carbon fibers, said second precursor fiber bundle having 30,000 or more filaments, in the transverse direction of the starting end, at least at two positions apart from each other in the longitudinal direction, wherein said second fiber bundle holding means comprises a second flat holding element for flatly opening said second precursor fiber bundle at said starting end, (c) an intervening fiber bundle holding means for holding a flatly opened starting end and a flatly opened terminal end of an intervening fiber bundle comprising many filaments having non-exothermic property at stabilizing treatment temperature, in the transverse direction of the starting and terminal ends, at least at two positions apart from each other in the longitudinal direction, (d) a first interlacing treatment means for interlacing the filaments with each other at the terminal end of said first precursor fiber bundle and the starting end of said intervening fiber bundle, and (e) a second interlacing treatment means for interlacing the filaments with each other at the starting end of said second precursor fiber bundle and the terminal end of said intervening fiber bundle, wherein (f) said first fiber bundle holding means and said second fiber bundle holding means are provided in such a manner that the tip of the terminal end of said first precursor fiber bundle and the tip of the starting end of said second precursor fiber bundle are subjected to face each other, (g) said intervening fiber bundle holding means is provided in such a manner that the intervening fiber bundle is subjected to overlap with said first precursor fiber bundle held by said first fiber bundle holding means and said second precursor fiber bundle held by said second fiber bundle holding means, (h) said first interlacing treatment means comprises a nozzle device which is divided into a nozzle top and a nozzle bottom in both of which many nozzle holes are formed, in which said nozzle top and said nozzle bottom are able to de-couple each other during placing said terminal end of said first precursor fiber bundle and said starting end of said intervening fiber bundle in flatly opened in said nozzle device and to couple each other during said interlacing, and (i) said second interlacing treatment means comprises a nozzle device which is divided into a nozzle top and a nozzle bottom in both of which many nozzle holes are formed, in which said nozzle top and said nozzle bottom are able to de-couple each other during placing said starting end of said second precursor fiber bundle and said terminal end of said intervening fiber bundle in flatly opened in said nozzle device and to couple each other during said interlacing.

8. An apparatus for producing a precursor fiber bundle for manufacture of carbon fibers according to claim 7, wherein said first interlacing treatment means and said second interlacing treatment means are filament interlacing treatment means using fluid respectively.

9. An apparatus for producing a precursor fiber bundle for manufacture of carbon fibers, comprising (a) a first fiber bundle holding means for holding a flatly opened terminal end of a first precursor fiber bundle for manufacture of carbon fibers, said first precursor fiber bundle having 30,000 or more filaments, in the transverse direction of the terminal end, at least at two positions apart from each other in the longitudinal direction, wherein said first precursor fiber bundle holding means comprises a first flat holding element for flatly opening said first precursor fiber bundle at said terminal end, (b) a second fiber bundle holding means for holding a flatly opened starting end of a second precursor fiber bundle for manufacture of carbon fibers, said second precursor fiber bundle having 30,000 or more filaments, in the transverse direction of the starting end, at least at two positions apart from each other in the longitudinal direction, wherein said second fiber bundle holding means comprises a second flat holding element for flatly opening said second precursor fiber bundle at said terminal end, and (c) an interlacing treatment means for interlacing the filaments with each other at the terminal end of said first precursor fiber bundle and the starting end of said second precursor fiber bundle, wherein (d) said first fiber bundle holding means and said second fiber bundle holding means are provided in such a manner that said first precursor fiber bundle held by said first fiber bundle holding means and said second precursor fiber bundle held by said second fiber bundle holding means are subjected to overlap with each other, and (e) said interlacing treatment means comprises a nozzle device which is divided into a nozzle top and a nozzle bottom in both of which many nozzle holes are formed, in which said nozzle top and said nozzle bottom are able to de-couple each other during placing said terminal end of said first precursor fiber bundle and said starting end of said second precursor fiber bundle in flatly opened in said nozzle device and to couple each other during said interlacing.

10. An apparatus for producing a precursor fiber bundle for manufacture of carbon fibers according to claim 9, wherein said interlacing treatment means is filament interlacing treatment means using fluid.

11. A method for manufacturing a carbon fiber bundle, comprising (a) a step comprises holding the terminal end of a first precursor fiber bundle having 30,000 or more filaments having crimps for manufacture of carbon fibers with two fiber bundle holding means apart from each other, moving said two fiber bundle holding means in the directions parting from each other in the longitudinal direction of said first precursor fiber bundle to vanish said crimps in said first precursor fiber bundle located between said two fiber bundle holding means, and after that heating said first precursor fiber bundle by catching between planar heaters on both sides to de-crimp said crimps, (b) a step comprises holding the terminal end of a second precursor fiber bundle having 30,000 or more filaments having crimps for manufacture of carbon fibers with two fiber bundle holding means apart from each other, moving said two fiber bundle holding means in the directions parting from each other in the longitudinal direction of said second precursor fiber bundle to vanish said crimps in said second precursor fiber bundle located between said two fiber bundle holding means, and after that heating said second precursor fiber bundle by catching between planar heaters on both sides to de-crimp said crimps, (c) a step comprises overlaying a flatly opened terminal end of a first precursor fiber bundle produced by the step (a) and a flatly opened starting end of an intervening fiber bundle comprising many filaments having a non-exothermic property, holding said bundles overlaid each other with two relax holding means apart from each other and moving said two relax holding means to relax said bundles located between said two relax holding means, and after that substantially uniformly interlacing the filaments of both of said bundles with each other to form a first joinder portion, (d) a step comprises overlaying a flatly opened starting end of a second precursor fiber bundle produced by the step (b) and a flatly opened terminal end of said intervening fiber bundle, holding said bundles overlaid each other with two relax holding means apart from each other and moving said two relax holding means to relax said bundles located between said two relax holding means, and after that substantially uniformly interlacing the filaments of both of said bundles with each other to form a second joinder portion, (e) a step of treating to stabilize a continuous precursor fiber bundle for manufacture of carbon fibers formed with said first and second precursor fiber bundles which are joined through said intervening fiber bundle at said first and second joinder portions, to obtain a stabilized bundle, and (f) carbonizing said stabilized fiber bundle, to obtain a carbon fiber bundle.

12. A method for manufacturing a carbon fiber bundle according to claim 11, wherein said intervening fiber bundle comprises a stabilized fiber bundle.

13. A method for manufacturing a carbon fiber bundle according to claim 12, wherein a relation of $0.4\times G \leqq F \leqq 1.5\times G$ is satisfied where F is the number of filaments of said stabilized fiber bundle of said intervening fiber bundle and G is the number of filaments of each of said precursor fiber bundles for manufacture of carbon fibers.

14. A method for manufacturing a carbon fiber bundle according to claim 11, wherein means for forming said first and second joinder portions comprise filament interlacing means using fluid respectively.

15. A method for manufacturing a carbon fiber bundle according to claim 14, wherein when the first and second joining portions are formed, a density of each of said fiber bundles overlapping to form said first and second joining portions is 4,000 filaments/mm or less.

16. A method for manufacturing a carbon fiber bundle according to claim 15, wherein where filaments in the first and second fiber bundles have crimps, the crimps of the filaments at the terminal end of said first fiber bundle and the starting end of said second fiber bundle are removed before forming said first and second joinder portions.

17. A method for manufacturing a carbon fiber bundle, comprising (a) a step comprises holding the terminal end of a first precursor fiber bundle having 30,000 or more filaments having crimps for manufacture of carbon fibers with two fiber bundle holding means apart from each other, moving said two fiber bundle holding means in the directions parting from each other in the longitudinal direction of said first precursor fiber bundle to vanish said crimps in said first precursor fiber bundle located between said two fiber bundle holding means, and after that heating said first precursor fiber bundle by catching between planar heaters on both sides to de-crimp said crimps, (b) a step comprises holding the terminal end of a second precursor fiber bundle having 30,000 or more filaments having crimps for manufacture of carbon fibers with two fiber bundle holding means apart from each other, moving said two fiber bundle holding means in the directions parting from each other in the longitudinal direction of said second precursor fiber bundle to vanish said crimps in said second precursor fiber bundle located between said two fiber bundle holding means, and after that heating said second precursor fiber bundle by catching between planar heaters on both sides to de-crimp said crimps, (c) a step comprises overlaying a flatly opened terminal end of a first precursor fiber bundle produced by the step (a) and a flatly opened starting end of a second precursor fiber bundle produced by the step (b), holding said bundles overlaid with two relax holding means spaced apart each other and moving said two relax holding means to relax said bundles located between said two relax holding means, and after that substantially uniformly interlacing the filaments of both of said bundles with each other to form a joinder portion, (d) a step of treating to stabilize a continuous precursor fiber bundle for manufacture of carbon fibers formed with said first and second fiber bundles which are joined at said joinder portions, to obtain a stabilized bundle, and (f) carbonizing said stabilized fiber bundle, to obtain a carbon fiber bundle.

18. A method for manufacturing a carbon fiber bundle according to claim 17, wherein means for forming the joinder portion comprises filament interlacing means using fluid.

19. A method for manufacturing a carbon fiber bundle according to claim 18, wherein when said joinder portion is formed, wherein the density of each of said fiber bundles overlapping to form said joinder portion is 4,000 filaments/mm or less.

20. A method for manufacturing a carbon fiber bundle according to claim 19, wherein where filaments in the first and second fiber bundles have crimps, the crimps of the filaments at the terminal end of said first fiber bundle and the starting end of said second fiber bundle are removed before forming said joinder portion.

21. A method for manufacturing a carbon fiber bundle according to claim 19, wherein after forming said joinder portion and before said stabilizing treatment, a stabilization inhibitor is applied to said joinder portion.

22. A method for manufacturing a carbon fiber bundle according to claim 21, wherein said stabilization inhibitor is boric acid water.

23. An apparatus for producing a precursor fiber bundle for manufacture of carbon fibers, comprising (a) a first two fiber bundle holding means provided apart from each other to hold the terminal end of a first precursor fiber bundle having 30,000 or more filaments having crimps for manufacture of carbon fibers, wherein said first two fiber bundle holding means are movable parting from each other in the longitudinal direction of said first precursor fiber bundle, and a first two planar heaters provided apart from each other between said first two fiber bundle holding means, wherein said first two planar heaters are movable approaching each other to catch said first precursor fiber bundle between them after movement of said first two fiber bundle holding means, (b) a second two fiber bundle holding means provided apart from each other to hold the terminal end of a second precursor fiber bundle having 30,000 or more filaments having crimps for manufacture of carbon fibers, wherein said second two fiber bundle holding means are movable parting from each other in the longitudinal direction of said second precursor fiber bundle, and a second two planar heaters provided apart from each other between said second two fiber bundle holding means, wherein said second planar heaters are movable approaching each other to catch said second precursor fiber bundle between them after movement of said second two fiber bundle holding means, (c) a first two relax holding means provided apart from each other to hold a flatly opened terminal end of said first precursor fiber bundle de-crimped by said first two fiber bundle holding means together with said first two planar heaters and a flatly opened starting end of an intervening fiber bundle comprising many filaments having a non-exothermic property overlaid with said flatly opened terminal end of said first precursor fiber bundle, wherein said first two relax holding means are movable approaching each other to relax said flatly opened terminal end of said first precursor fiber bundle and said flatly opened starting end of said intervening fiber bundle held between said first two relax holding means, (d) a second two relax holding means provided apart from each other to hold a flatly opened starting end of said second precursor fiber bundle de-crimped by said second two fiber bundle holding means together with said second two planar heaters and a flatly opened terminal end of said intervening fiber bundle overlaid with said flatly opened starting end of said second precursor fiber bundle, wherein said second two relax holding means are movable approaching each other to relax said flatly opened starting end of said second precursor fiber bundle and said flatly opened terminal end of said intervening fiber bundle held between said second two relax holding means, (e) a first interlacing treatment means for interlacing filaments with each other at said terminal end of said first precursor fiber bundle and said starting end of said intervening fiber bundle, and (f) a second interlacing treatment means for interlacing filaments with each other at said starting end of said second precursor fiber bundle and said terminal end of said intervening fiber bundle, wherein (g) said first interlacing treatment means comprises a nozzle device which is divided into a nozzle top and a nozzle bottom in both of which many nozzle holes are formed, in which said nozzle top and said nozzle bottom are able to de-couple each other during placing said terminal end of said first precursor fiber bundle and said starting end of said intervening fiber bundle in flatly opened in said nozzle device and to couple each other during said interlacing, and (h) said second interlacing treatment means comprises a nozzle device which is divided into a nozzle top and a nozzle bottom in both of which many nozzle holes are formed, in which said nozzle top and said nozzle bottom are able to de-couple each other during placing said starting end of said second precursor fiber bundle and said terminal end of said intervening fiber bundle in flatly opened in said nozzle device and to couple each other during said interlacing.

24. An apparatus for producing a precursor fiber bundle for manufacture of carbon fibers, comprising (a) a first two fiber bundle holding means provided apart from each other to hold the terminal end of a first precursor fiber bundle having 30,000 or more filaments having crimps for manufacture of carbon fibers, wherein said first two fiber bundle holding means are movable parting from each other in the longitudinal direction of said first precursor fiber bundle, and a first two planar heaters provided apart from each other between said first two fiber bundle holding means, wherein said first two planar heaters are movable approaching each other to catch said first precursor fiber bundle between them after movement of said first two fiber bundle holding means, (b) a second two fiber bundle holding means provided apart from each other to hold the terminal end of a second precursor fiber bundle having 30,000 or more filaments having crimps for manufacture of carbon fibers, wherein said second two fiber bundle holding means are movable parting from each other in the longitudinal direction of said second precursor fiber bundle, and a second two planar heaters provided apart from each other between said second two fiber bundle holding means, wherein said second planar heaters are movable approaching each other to catch said second precursor fiber bundle between them after movement of said second two fiber bundle holding means, (c) two relax holding means provided apart from each other to hold a flatly opened terminal end of said first precursor fiber bundle de-crimped by said first two fiber bundle holding means together with said first two planar heaters and a flatly opened starting end of said second precursor fiber bundle overlaid with said flatly opened terminal end of said first precursor fiber bundle, wherein said two relax holding means are movable approaching each other to relax said flatly opened terminal end of said first precursor fiber bundle and said flatly opened starting end of said starting end of said precursor fiber bundle held between said two relax holding means, and (d) an interlacing treatment means for interlacing filaments with each other at said terminal end of said first precursor fiber bundle and said starting end of said precursor fiber bundle, wherein (e) said interlacing treatment means comprises a nozzle device which is divided into a nozzle top and a nozzle bottom in both of which many nozzle holes are formed, in which said nozzle top and said nozzle bottom are able to de-couple each other during placing said terminal end of said first precursor fiber bundle and said starting end of said second precursor fiber bundle in flatly opened in said nozzle device and to couple each other during said interlacing.

* * * * *

UNITED STATES PATENT AND TRADEMARK OFFICE

CERTIFICATE OF CORRECTION

PATENT NO. : 6,485,592 B1
DATED : November 26, 2002
INVENTOR(S) : Yoshimura et al.

It is certified that error appears in the above-identified patent and that said Letters Patent is hereby corrected as shown below:

Column 25,
Line 57, Table 1-continued, Comparative Example 1, please change "220" to -- __ --, please change "40" to -- 220 --; please change "*2" to -- 40 --; and insert -- *2 -- at the sub-heading "Joining method".

Signed and Sealed this

Twentieth Day of January, 2004

JON W. DUDAS
*Acting Director of the United States Patent and Trademark Office*